US008855529B2

(12) United States Patent
Holmes et al.

(10) Patent No.: US 8,855,529 B2
(45) Date of Patent: Oct. 7, 2014

(54) DEVICES AND METHODS FOR REMANUFACTURING TONER PRINTER CARTRIDGES

(75) Inventors: Denny Holmes, Los Angeles, CA (US); Tigran Ohanyan, Van Nuys, CA (US)

(73) Assignee: Mitsubishi Kagaku Imaging Corporation, Glendale, CA (US)

( * ) Notice: Subject to any disclaimer, the term of this patent is extended or adjusted under 35 U.S.C. 154(b) by 416 days.

(21) Appl. No.: 13/200,491

(22) Filed: Sep. 23, 2011

(65) Prior Publication Data

US 2013/0039675 A1 Feb. 14, 2013

Related U.S. Application Data

(60) Provisional application No. 61/574,991, filed on Aug. 11, 2011.

(51) Int. Cl.
*G03G 15/00* (2006.01)
*G03G 15/08* (2006.01)

(52) U.S. Cl.
CPC .. *G03G 15/0894* (2013.01); *G03G 2215/00987* (2013.01)
USPC ..... 399/109

(58) Field of Classification Search
CPC ..... G03G 2215/00987
USPC ..... 399/109
See application file for complete search history.

(56) References Cited

U.S. PATENT DOCUMENTS 7,505,708 B2 * 3/2009 Ohanyan et al. ..... 399/109

* cited by examiner

*Primary Examiner* — David Gray
*Assistant Examiner* — Michael Harrison

(57) ABSTRACT

There is provided a device and method for aligning a doctor blade in a toner hopper of toner printer cartridge. In one embodiment there is provided a device for aligning a doctor blade in a toner hopper of a toner printer cartridge where the device has a base portion, at least one cartridge portion holding element on the base portion, and an alignment assembly portion setting a doctor blade alignment setting and aligning a doctor blade in a toner hopper retained by the cartridge portion holding element.

18 Claims, 23 Drawing Sheets

DEVICES AND METHODS FOR REMANUFACTURING TONER PRINTER CARTRIDGES

CROSS REFERENCE TO RELATED APPLICATIONS

This application claims the benefit of U.S. Provisional Patent Application Ser. No. 61/574,991, filed Aug. 11, 2011, which is incorporated herein by reference in its entirety.

BACKGROUND a. Field of the Invention

The disclosure relates to electrophotography, and in particular, devices and methods for manufacturing or remanufacturing toner printer cartridges b. Background Art Printer cartridges, such as toner printer cartridges, are used in various electrophotographic imaging devices, such as laser printers, copiers, facsimile machines, and multifunction imaging devices. Once original equipment manufacturer (OEM) toner printer cartridges are used, they are often recycled and remanufactured. The process of remanufacturing a toner printer cartridge may include cleaning the cartridge, repairing damaged parts, replacing worn parts, reassembling with new parts, and replenishing the cartridge with toner. The process of remanufacturing a toner printer cartridge requires that the toner printer cartridge be disassembled so that access to the various component parts may be achieved, and further requires that the toner printer cartridge be reassembled for subsequent use.

The component parts of toner printer cartridges typically include a toner hopper, a waste hopper, a doctor blade or doctor bar, a primary charge roller (PCR), a developer roller, and an organic photoconductive (OPC) drum. The term "doctor blade" is a commonly used term in the toner printer cartridge manufacturing and remanufacturing industries and refers to an elongated material that usually includes an elongated rod with an elongated blade attached to the elongated rod. The elongated rod is usually made of metal, and the elongated blade may be made of plastic or metal. The blade may be positioned at an angle from the rod and may be positioned proximate to the developer roller with a predetermined distance.

When the toner printer cartridge is in operation, the doctor blade is typically stationary while the developer roller rolls next to the blade. The doctor blade ensures that the right amount of toner sticks to the developer roller. However, not all toner may be absorbed by the developer roller. The toner that is not absorbed by the developer roller typically accumulates around the developer roller. Since the doctor blade and the developer roller are separated by a relatively small predetermined space, the blade controls the thickness of the toner that adheres to the developer roller by scraping off toner that is not absorbed by the developer roller. If there is an excess amount of toner on the developer roller, the doctor blade scrapes off the excess amount. The developer roller then transfers the toner to the OPC drum. The OPC drum that is coated with toner then rolls over a sheet of paper, which is usually given a negative charge by the PCR. The charge of the paper is typically less negative than the charge of the toner, and thus the paper attracts the toner. The toner may be embedded on the paper according to the print pattern.

The doctor blade and the developer roller are usually detached from the toner printer cartridge during the remanufacturing process for cleaning. After cleaning, the doctor blade and the developer roller may be reassembled together usually manually with a screw driver. An assembler or user may align or position the doctor blade above the developer roller. The assembler or user may press on one side of the doctor blade and then attach with attachment means, such as screws, the same side of the doctor blade to the toner printer cartridge. The assembler or user may then execute the same steps on the remaining side. Aligning and positioning the doctor blade during replacement and remanufacture may require that the doctor blade be aligned or positioned within a few millimeters of an acceptable alignment or position point to maximize print quality during printing. Many known OEM toner printer cartridges are designed to have a doctor blade that may have the capability of being adjustable in order to adjust the doctor blade position. Thus, it may be difficult for the remanufacturer to manually align the doctor blade to the correct position.

Known methods of assembly, manufacture, or remanufacture of toner printer cartridges may not provide a uniform distance between the doctor blade and the developer roller from one side of the doctor blade to the other. As a result, the print quality may be affected, as the toner level on the developer roller is not effectively regulated by the doctor blade. One side of the developer roller may produce darker images than the other, or vice-versa. Moreover, known methods of assembly, manufacture, or remanufacture of toner printer cartridges, such as positioning or aligning a doctor blade, may require an assembler or user to manually align and position the doctor blade and may result in misalignment or damage to the doctor blade. For example, an assembler or user may have to manually hold the doctor blade in order to tighten fasteners such as screws to secure the doctor blade to the toner hopper.

In addition, known methods of assembly or remanufacture of toner printer cartridges may require permanent attachment of two or more spacers, inserts, shims, or other spacing elements within the gap or area formed between the doctor blade and the printer cartridge body in order to maintain a desired gap or area distance. The use of such permanent spacers, inserts, shims, or other spacing elements may increase the overall cost and complexity and decrease the overall efficiency of the assembly, manufacturing, or remanufacturing processes. Moreover, such spacers, inserts, shims, or spacing elements may have to have a required thickness that may limit the type of spacer, insert, shim, or spacing element that may be used.

Accordingly, there is a need for an improved device and method for assembling, manufacturing, and remanufacturing toner printer cartridges, including aligning doctor blades, that overcomes the issues associated with known devices and methods.

SUMMARY

This need for an improved device and method for remanufacturing toner printer cartridges, including aligning doctor blades, is satisfied.

There is provided in one embodiment a device for aligning a doctor blade in a toner hopper of a toner printer cartridge. The device comprises a base portion. The device further comprises at least one cartridge portion holding element on the base portion. The device further comprises an alignment assembly portion setting a doctor blade alignment setting and aligning a doctor blade in a toner hopper retained by the cartridge portion holding element.

There is provided in another embodiment a method for aligning a doctor blade in a toner hopper of a remanufactured toner printer cartridge. The method comprises providing a doctor blade alignment device comprising at least an alignment assembly portion configured to set a doctor blade alignment setting. The method further comprises calibrating the doctor blade alignment device with a calibration doctor blade in a calibration toner hopper and with the alignment assembly portion to obtain a calibrated doctor blade alignment setting. The method further comprises aligning a doctor blade in a toner hopper of a remanufactured toner printer cartridge with the calibrated doctor blade alignment setting.

There is provided in another embodiment a method of remanufacturing a toner printer cartridge, the toner printer cartridge having a toner hopper with a doctor blade. The method comprises the step of providing a doctor blade alignment device comprising at least an alignment assembly portion to set a doctor blade alignment setting. The method further comprises the step of coupling a pin setting element to each end of a first calibration doctor blade in a first calibration toner hopper. The method further comprises the step of securing the first calibration toner hopper having the first calibration doctor blade to the doctor blade alignment device. The method further comprises the step of calibrating the doctor blade alignment device with the alignment assembly portion to obtain a calibrated doctor blade alignment setting. The method further comprises the step of removing the first calibration toner hopper with the first calibration doctor blade from the calibrated doctor blade alignment device. The method further comprises the step of securing a toner hopper with a doctor blade requiring alignment to the calibrated doctor blade alignment device. The method further comprises the step of aligning the doctor blade in the toner hopper with the calibrated doctor blade alignment setting to obtain an aligned doctor blade. The method further comprises the step of removing the toner hopper with the aligned doctor blade from the calibrated doctor blade alignment device. The method further comprises the step of using the toner hopper with the aligned doctor blade in a remanufactured toner printer cartridge.

The above description sets forth, rather broadly, a summary of the disclosed embodiments so that the detailed description that follows may be better understood and contributions of the invention to the art may be better appreciated. Some of the disclosed embodiments may not include all of the features or characteristics listed in the above summary. There may be, of course, other features of the disclosed embodiments that will be described below and may form the subject matter of claims. The features, functions, and advantages that have been discussed can be achieved independently in various embodiments of the disclosure or may be combined in yet other embodiments further details of which can be seen with reference to the following description and drawings.

DESCRIPTION OF DRAWINGS

The invention can be better understood with reference to the following detailed description taken in conjunction with the accompanying drawings which illustrate preferred and exemplary embodiments, but which are not necessarily drawn to scale, wherein.

DETAILED DESCRIPTION

Disclosed embodiments will now be described more fully herein after with reference to the accompanying drawings, in which some, but not all disclosed embodiments are shown. Indeed, several different embodiments may be provided and should not be construed as limited to the embodiments set forth herein. Rather, these embodiments are provided so that this disclosure will be thorough and complete and will fully convey the scope of the disclosure to those skilled in the art. It is to be understood that other embodiments may be utilized and structural changes may be made without departing from the scope of the invention. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

The disclosed embodiments provide various devices and methods for remanufacturing printer cartridges, such as toner printer cartridges, and in particular, for aligning and positioning a doctor blade in a toner hopper of a toner printer cartridge or remanufactured toner printer cartridge or for aligning and positioning a calibration doctor blade in a calibration toner hopper of a calibration toner printer cartridge. The disclosed embodiments of the devices and methods may be used with toner printer cartridges that can be used in laser printer models, such as, for example, Hewlett Packard (HP) Company HPCP1025, HPCP4525, or HPCP4025 HP families of laser printers, or may also be used with other suitable toner printer cartridges.

Figure 1A:
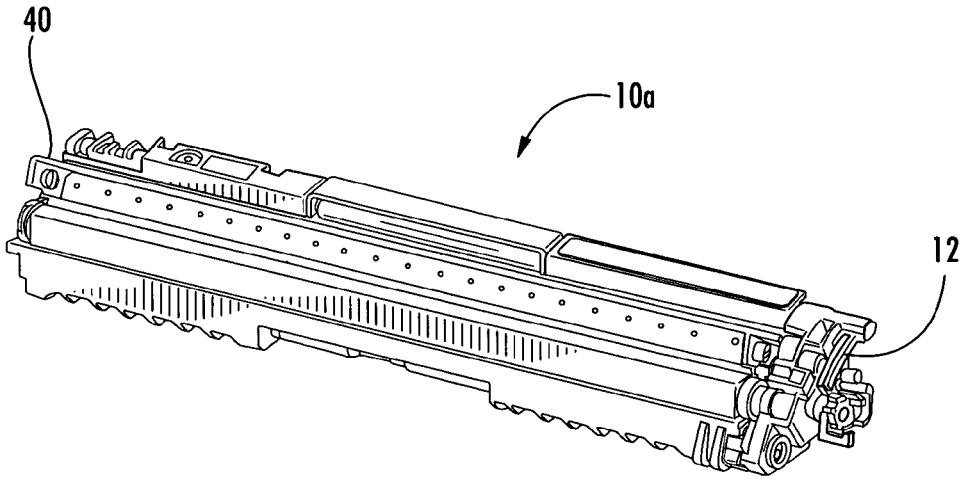
FIG. 1A (PRIOR ART)
FIG. 1A shows a front perspective view of a known toner printer cartridge for which disclosed embodiments of the device and method of the disclosure may be applied.
Figure 1B:
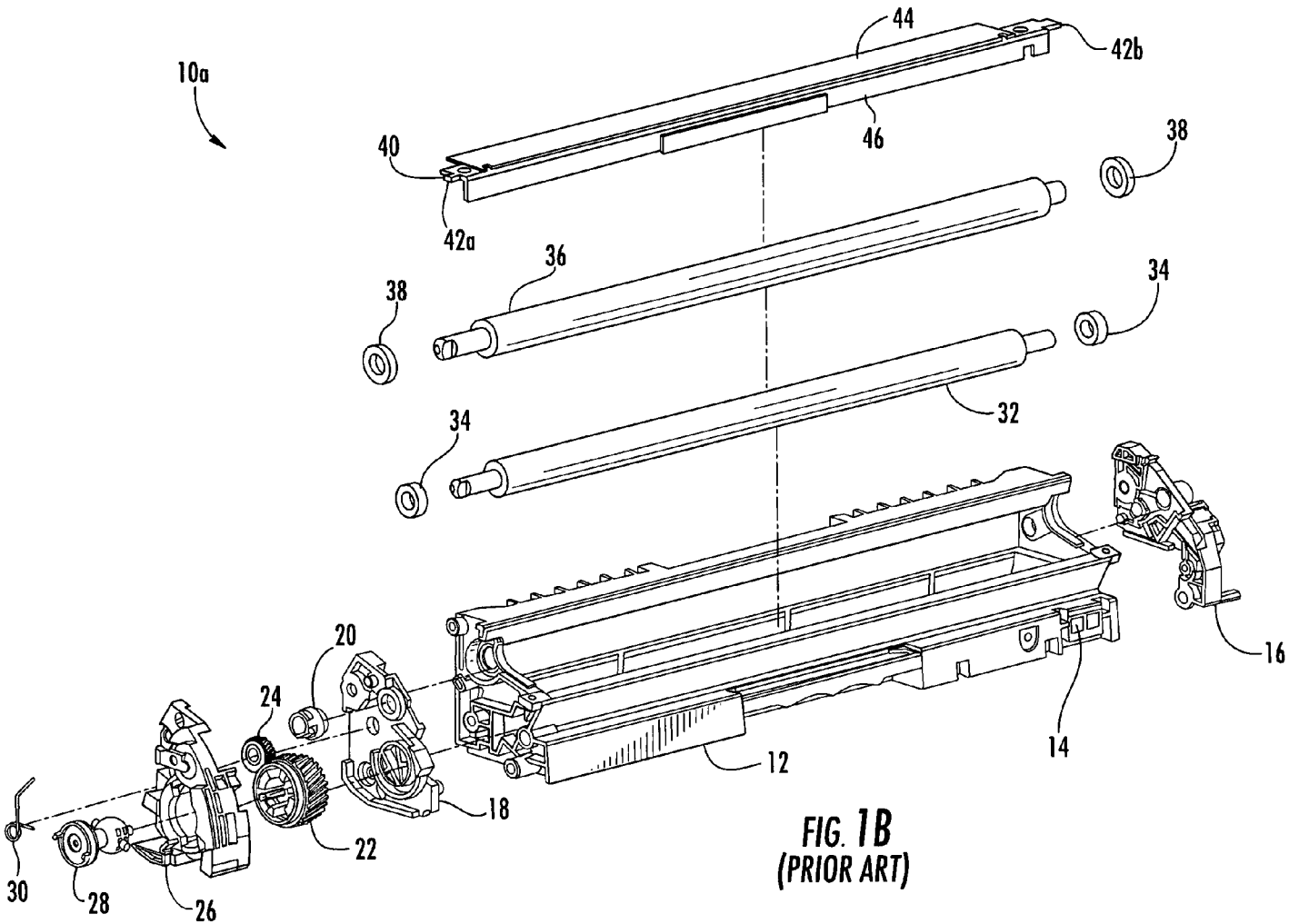
FIG. 1B (PRIOR ART)
FIG. 1B shows a front perspective exploded view of the known toner printer cartridge of FIG. 1A for which disclosed embodiments of the device and method of the disclosure may be applied.

Embodiments of a doctor blade alignment device 50 (see FIG. 7) in various embodiments 50*a* (see FIG. 3A), 50*b* (see FIG. 5A) and 50*c* (see FIG. 10A), and related method 300 (see FIG. 12) and method 400 (see FIG. 13) are provided. Referring to the Figures, FIG. 1A shows a front perspective view of a known toner printer cartridge 10*a* for which disclosed embodiments of the device and printer remanufacturing method of the disclosure may be applied. FIG. 1B shows a front perspective exploded view of the known printer cartridge 10*a* for which disclosed embodiments of the device and printer remanufacturing method of the disclosure may be applied. As shown in FIG. 1B, the toner printer cartridge 10*a* comprises a toner hopper 12 having a chip 14, a developer roller contact side end cap 16, a developer roller end cap 18, a developer roller gear 20, a drive axle gear 22, a supply roller gear 24, a gear housing end cap 26, a drive axle 28, a drive axle spring 30, a supply roller 32 with supply roller sealing foam elements 34, a developer roller 36 with developer roller bushings 38, and a doctor blade 40 having a first end 42*a*, a second end 42*b*, a blade portion 44, and a support portion 46.

Figure 2A:
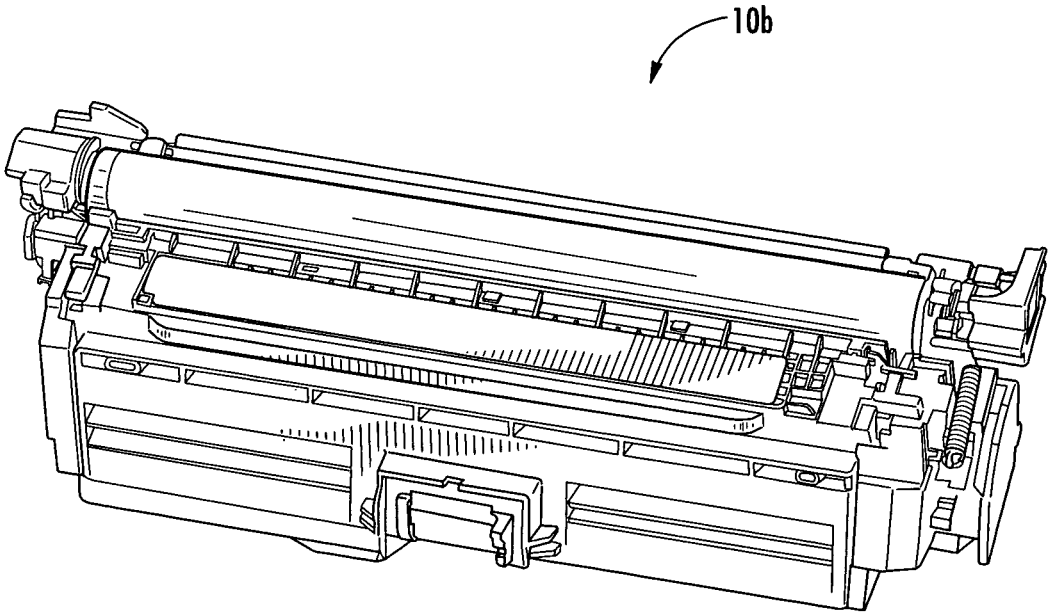
FIG. 2A (PRIOR ART)
FIG. 2A shows a front perspective view of another known toner printer cartridge for which disclosed embodiments of the device and method of the disclosure may be applied.
Figure 2B:
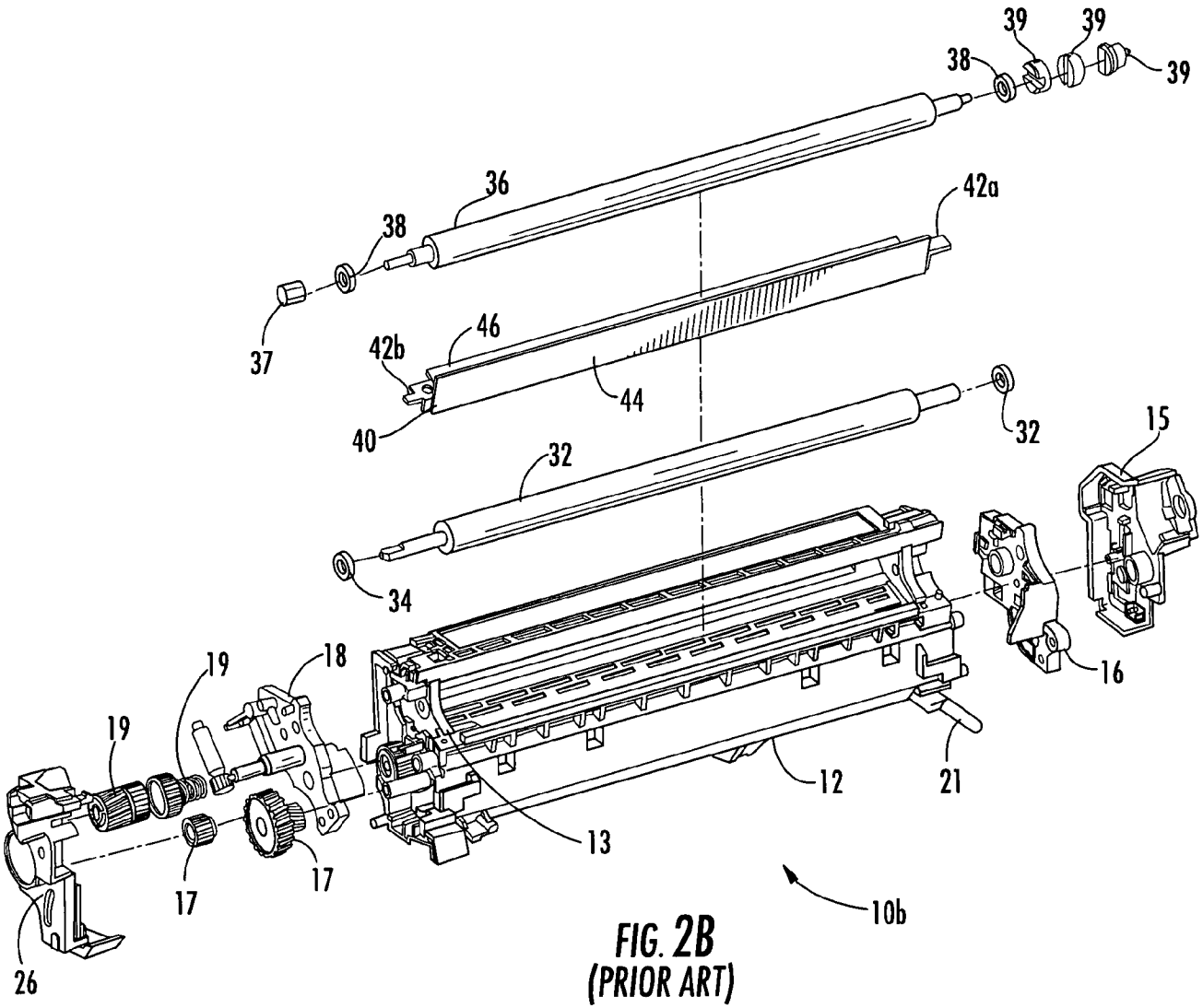
FIG. 2B (PRIOR ART)
FIG. 2B shows a front perspective exploded view of the known toner printer cartridge of FIG. 2A for which disclosed embodiments of the device and method of the disclosure may be applied.

FIG. 2A shows a front perspective view of another known toner printer cartridge 10*b* for which disclosed embodiments of the device and printer remanufacturing method of the disclosure may be applied. FIG. 2B shows a front perspective exploded view of known printer cartridge 10*b* for which disclosed embodiments of the device and printer remanufacturing method of the disclosure may be applied. As shown in FIG. 2B, the toner printer cartridge 10*b* comprises a toner hopper 12 having developer roller end felt 13, a toner hopper end cap 15, a developer roller contact side end cap 16, a toner housing agitator gear 17, a developer roller end cap 18, seal pulling gears 19, a tension spring 21, a gear housing end cap 26, a supply roller 32 with supply roller sealing foam 34, a developer roller 36 with developer roller bushings 38, a developer roller gear 37, and developer roller drive gears 39, and a doctor blade 40 having a first end 42*a*, a second end 42*b*, a blade portion 44, and a support portion 46.

Figure 3A:
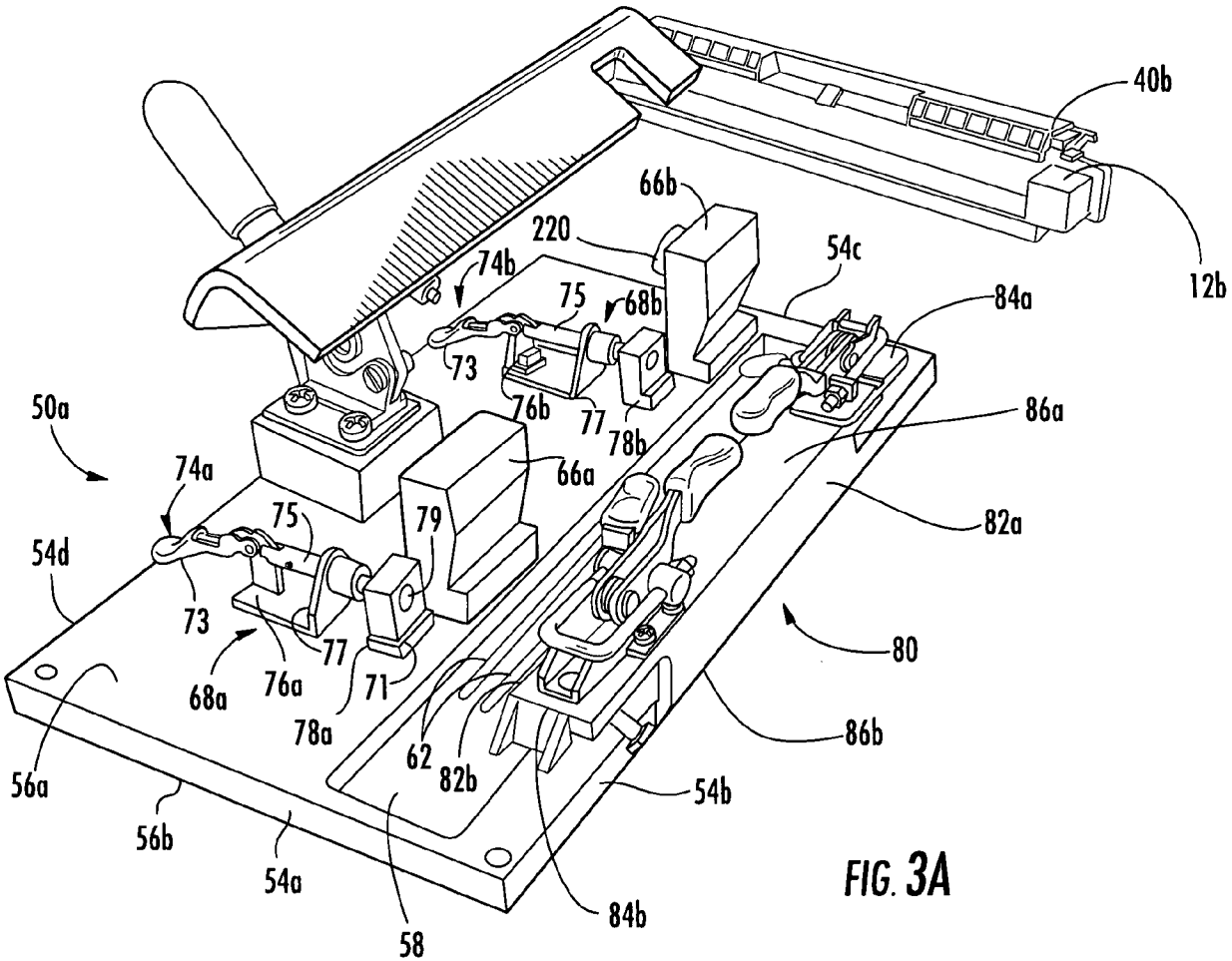
FIG. 3A is a left front perspective view of one of the embodiments of a device of the disclosure.
Figure 3B:
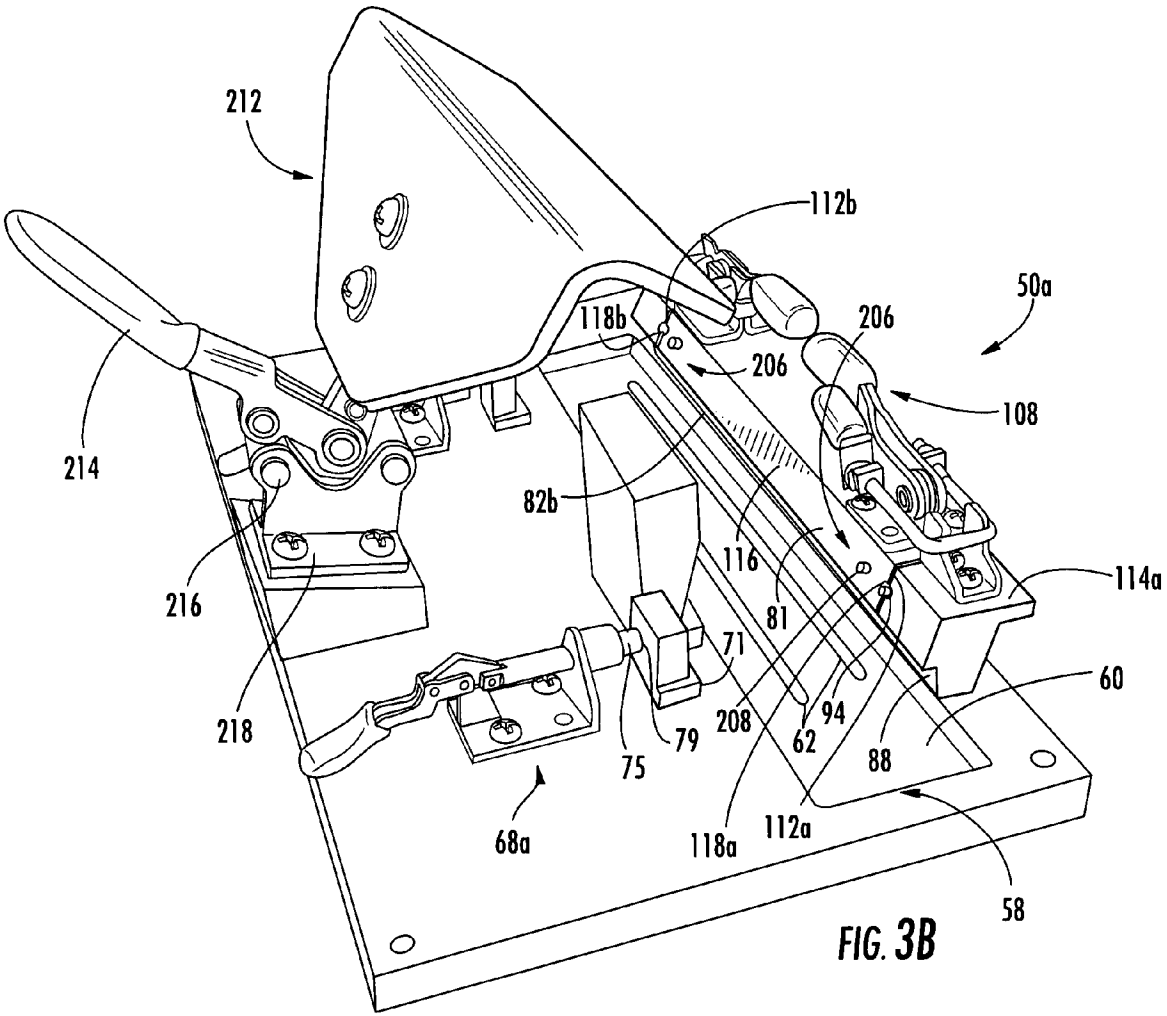
FIG. 3B is a left back perspective view of the device of FIG. 3A.
Figure 3C:
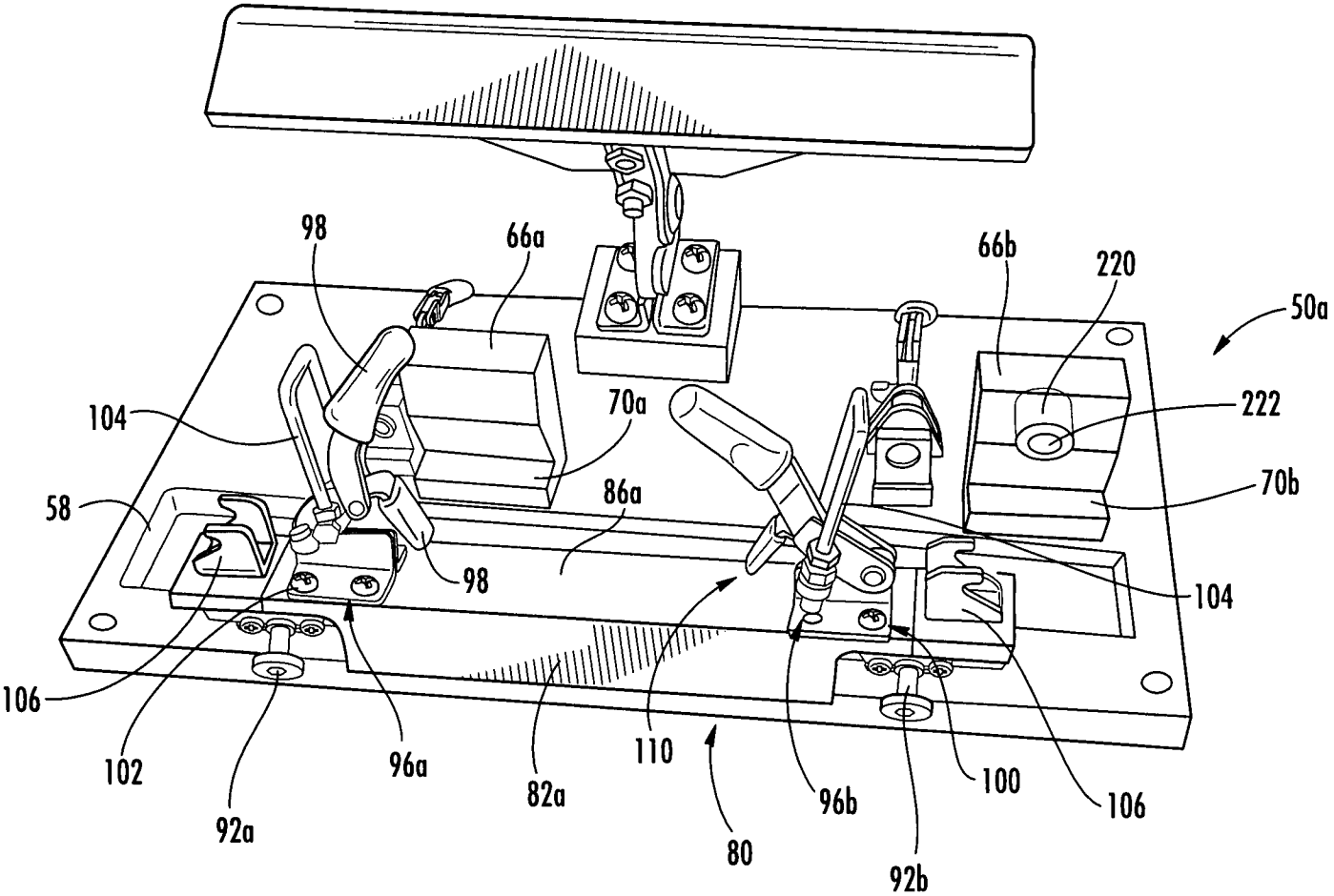
FIG. 3C is a front perspective view of the device of FIG. 3A.

As shown in FIGS. 3A-3C, there is provided in one embodiment a doctor blade alignment device 50*a* for aligning and positioning a doctor blade 40 (see FIG. 1B) in a toner hopper 12 of a toner printer cartridge 10*a*, 10*b* or another suitable toner printer cartridge. FIG. 3A a left front perspective view of one of the embodiments of the device 50*a* of the disclosure. FIG. 3B a left back perspective view of the device 50*a* of FIG. 3A. FIG. 3C a front perspective view of the device 50*a* of FIG. 3A. The doctor blade alignment device 50*a* may also be used with a second calibration toner hopper 12*b* (see FIG. 3A) having a second calibration doctor blade 40*b* (see FIG. 3A).

Figure 4A:
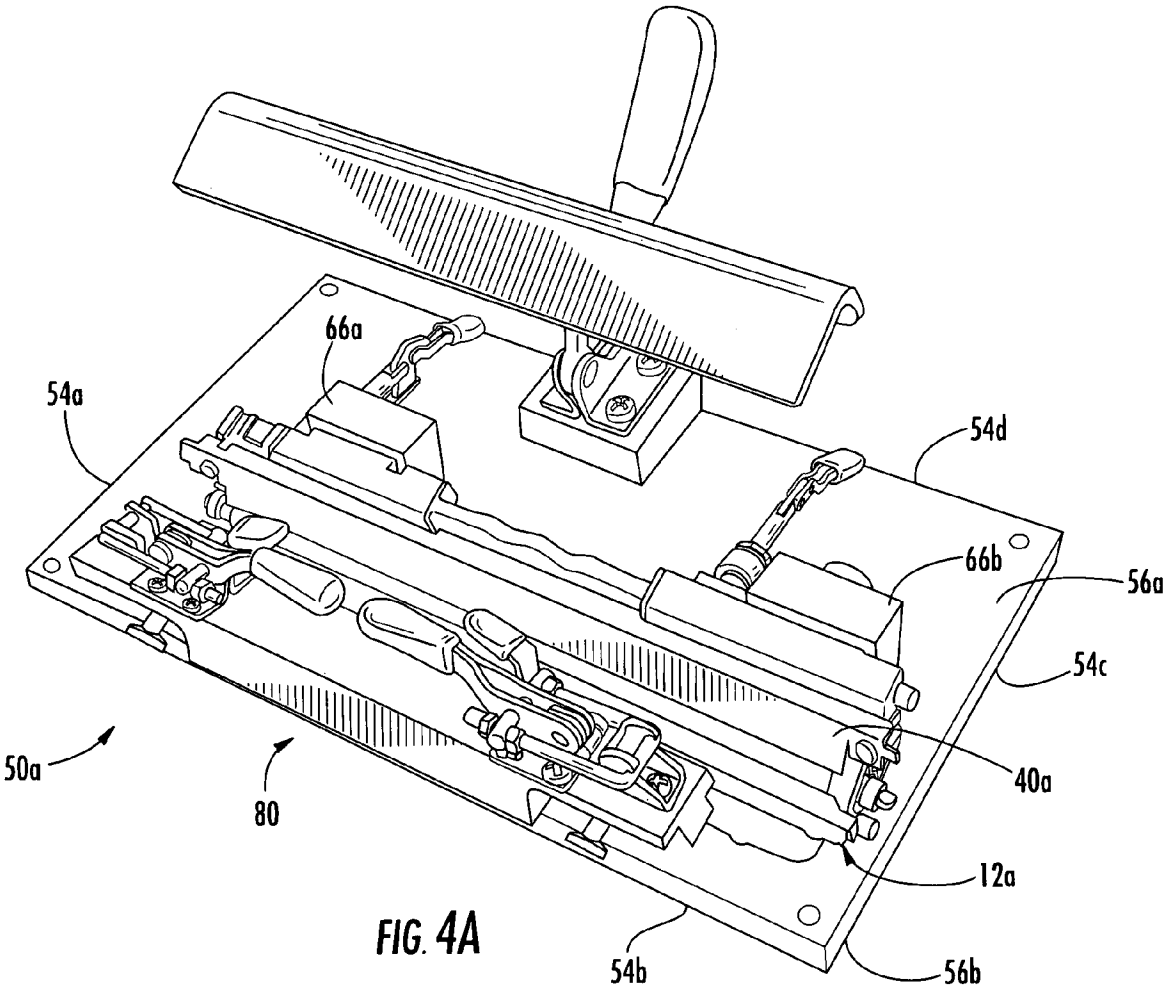
FIG. 4A is a top perspective view of one of the embodiments of a device of the disclosure showing a calibration toner hopper installed in the device.
Figure 4B:
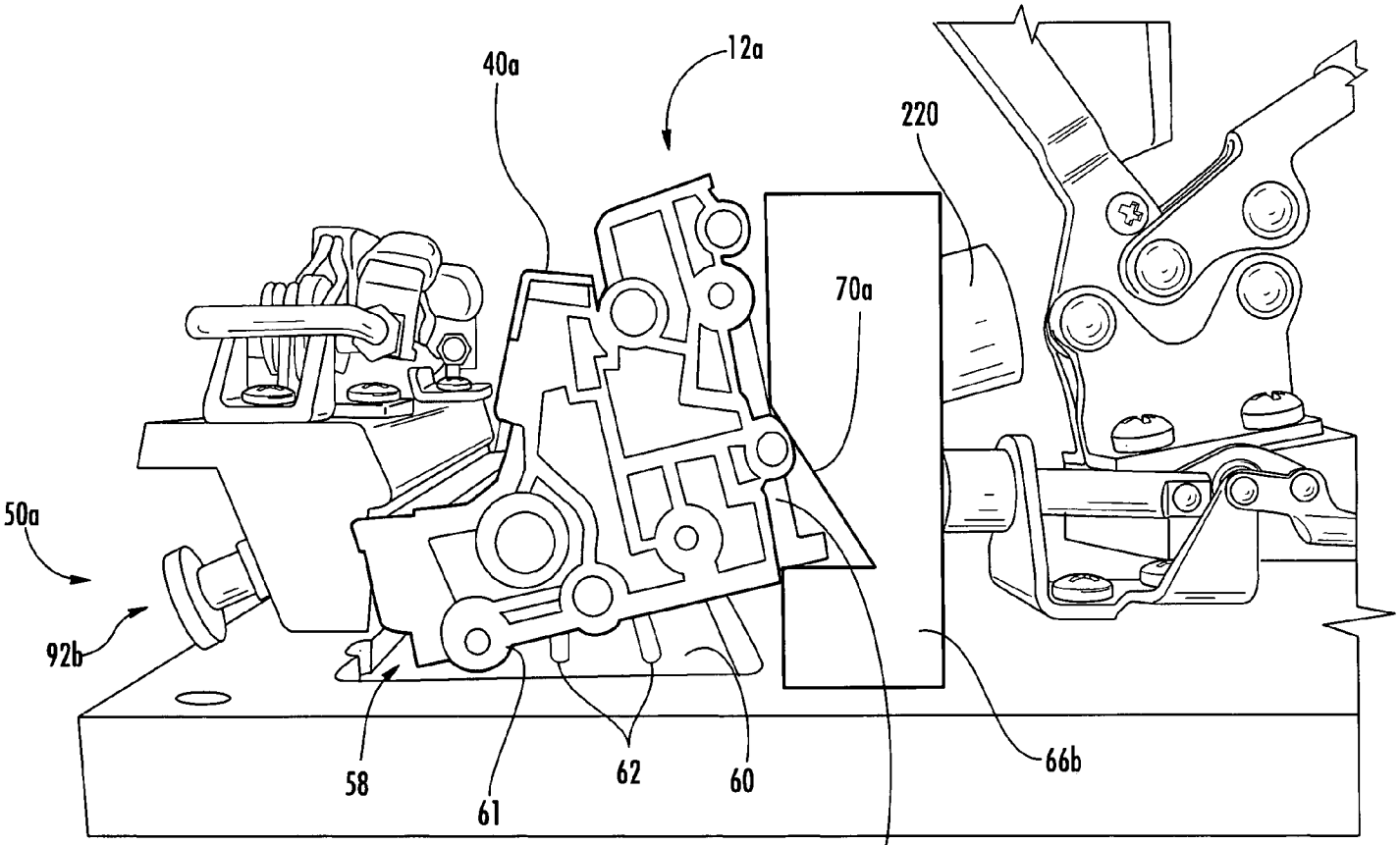
FIG. 4B is a right side close-up view of the device of FIG. 4A showing the calibration toner hopper installed in the device.
Figure 4C:
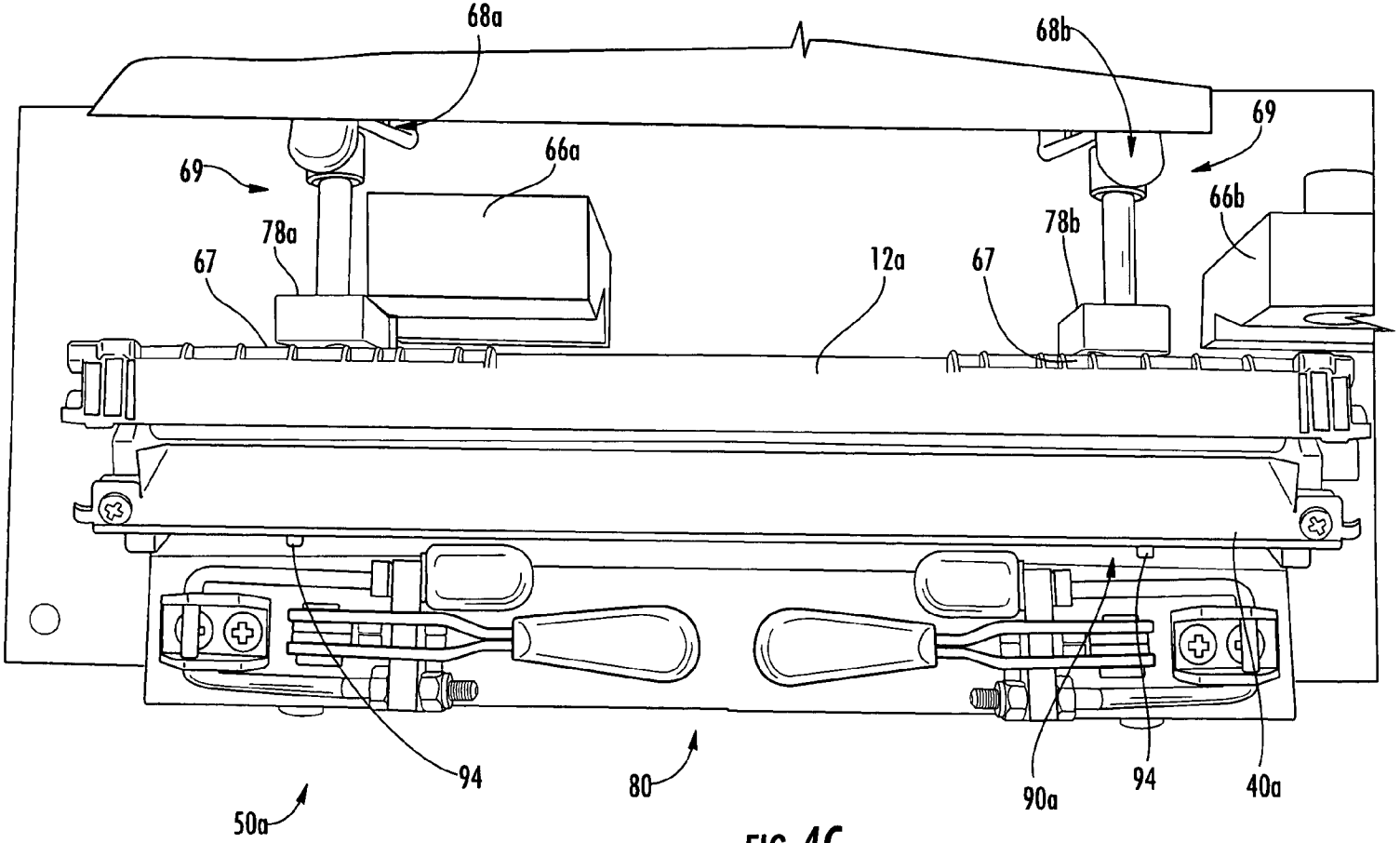
FIG. 4C is a top close-up perspective view of the device of FIG. 4A showing the calibration doctor blade in the calibration toner hopper installed in the device.

As shown in FIGS. 4A-4C, there is provided in one embodiment a doctor blade alignment device 50*a* for aligning and positioning a calibration doctor blade 40*a* (see FIG. 4A) in a calibration toner hopper 12*a* (see FIG. 4A) of a toner printer cartridge 10*a*, 10*b* or another suitable toner printer cartridge. FIG. 4A is a top perspective view of one of the embodiments of the device 50*a* of the disclosure showing a calibration toner hopper 12*a* installed in the device 50*a*. FIG. 4B is a right side close-up view of the device 50*a* of FIG. 4A showing the calibration toner hopper 12*a* installed in the device 50*a*. FIG. 4C is a top close-up perspective view of the device 50*a* of FIG. 4A showing the calibration doctor blade 40*a* in the calibration toner hopper 12*a* installed in the device 50*a*.

Figure 5A:
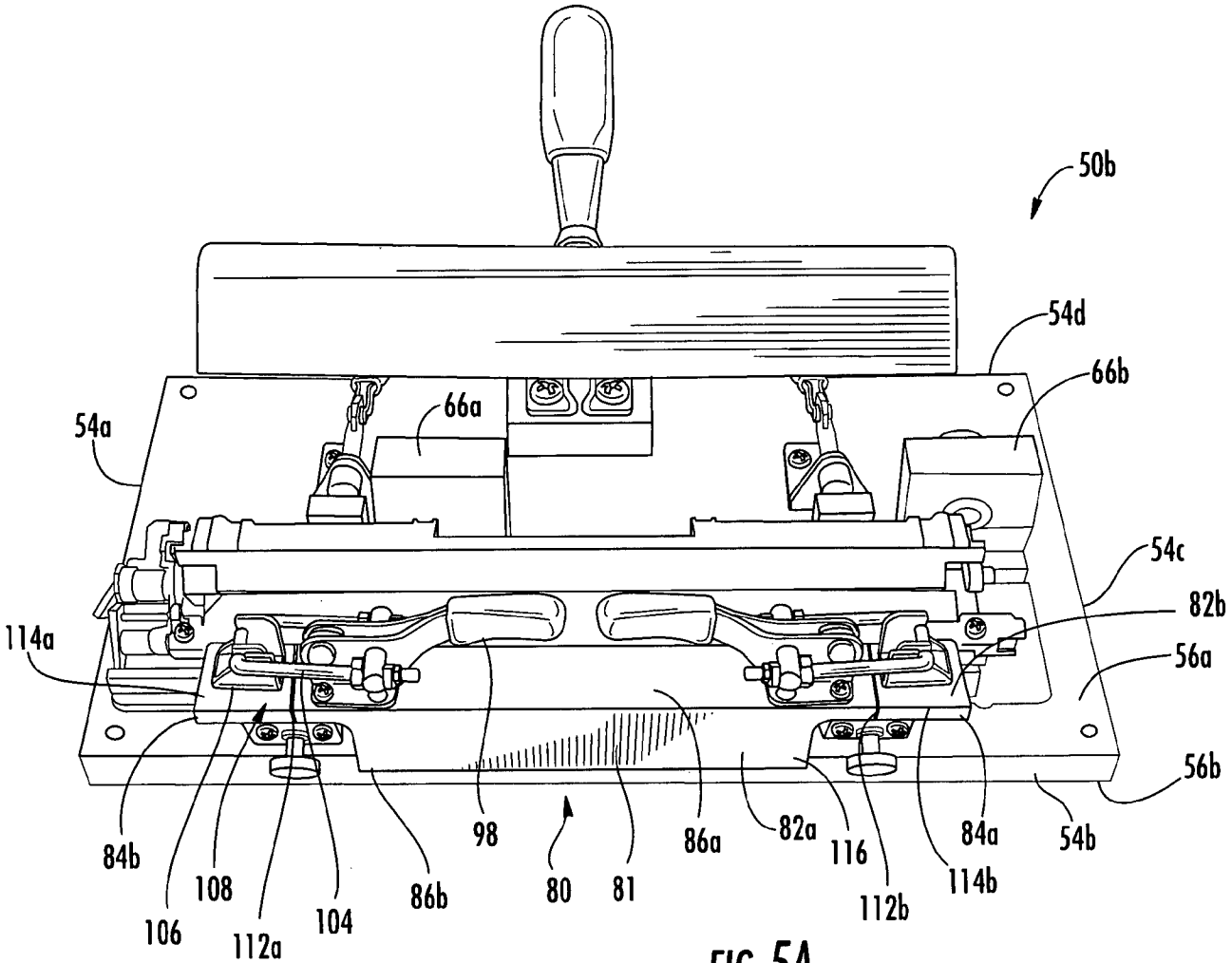
FIG. 5A is a top perspective view of another one of the embodiments of a device of the disclosure showing a toner hopper installed in the device.
Figure 5B:
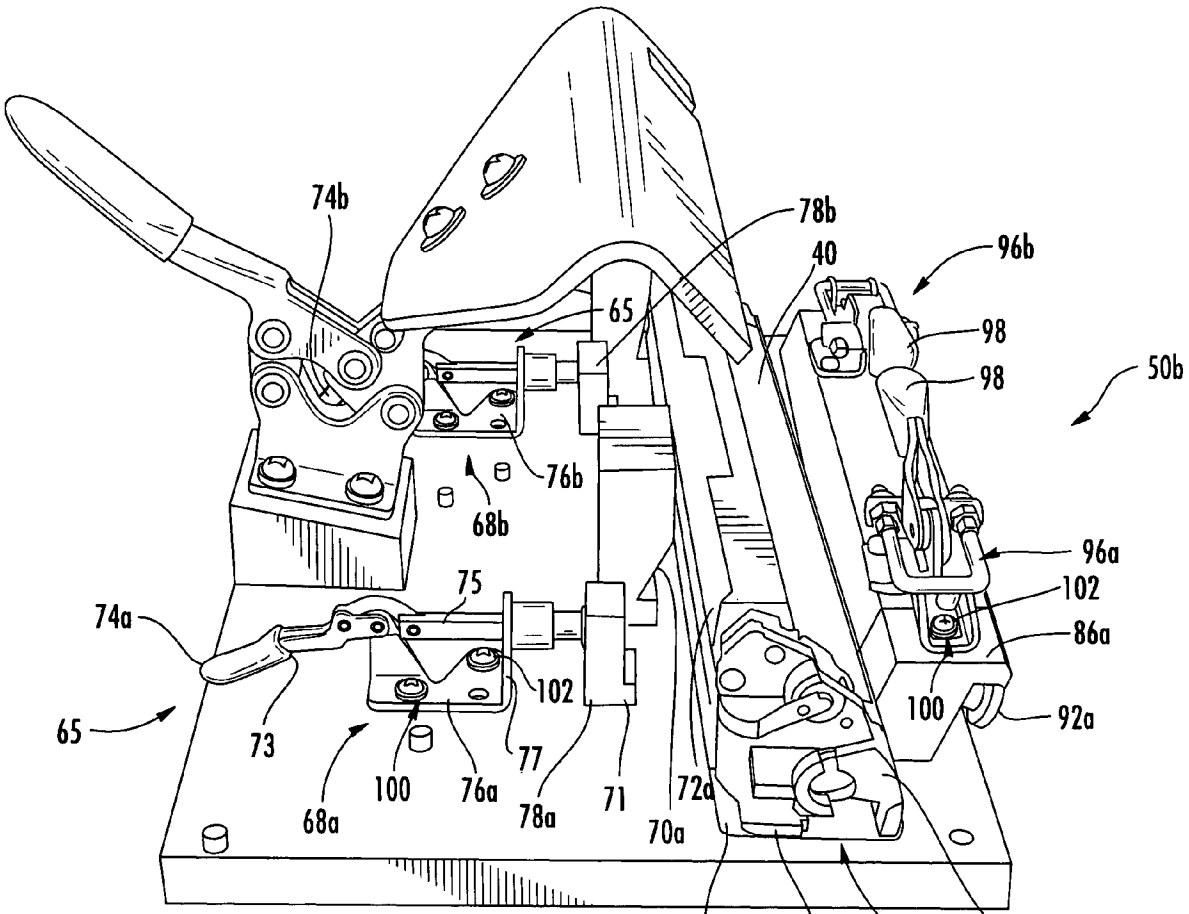
FIG. 5B is a left side perspective view of the device of FIG. 5A showing the doctor blade in the toner hopper installed in the device.

As shown in FIGS. 5A-5B, there is provided in another embodiment a doctor blade alignment device 50*b* for aligning and positioning the doctor blade 40 (see FIG. 5B) in the toner hopper 12 of the toner printer cartridge 10*a* (see FIG. 1A), 10*b* (see FIG. 2A) or another suitable toner printer cartridge. FIG. 5A is a top perspective view of the device 50*b* of the disclosure showing the toner hopper 12 installed in the device 50*b*. FIG. 5B is a left side perspective view of the device 50*b* of FIG. 5A showing the doctor blade 40 in the toner hopper 12 installed in the device 50*b*.

Figure 10A:
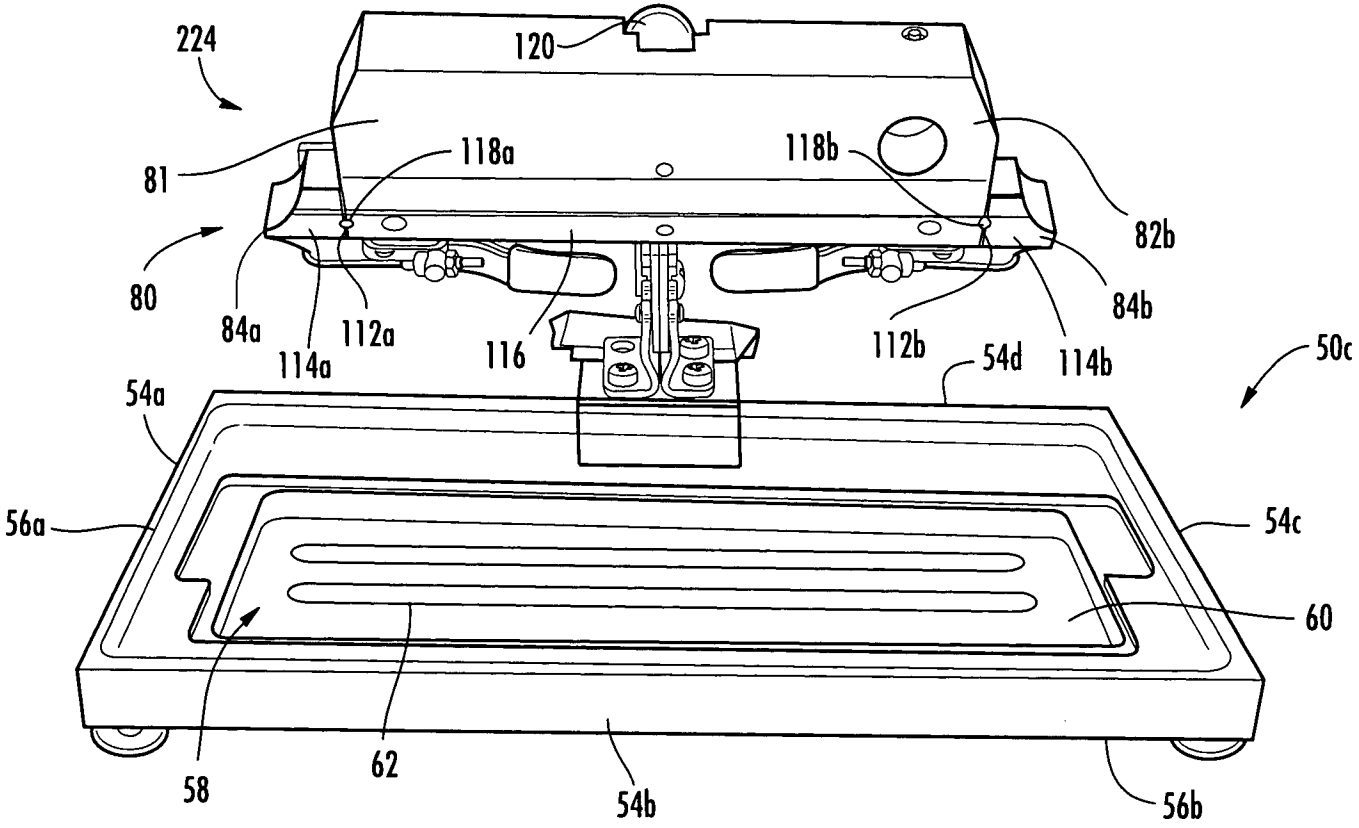
FIG. 10A is a front perspective view of another one of the embodiments of a device of the disclosure shown in an open position.
Figure 10B:
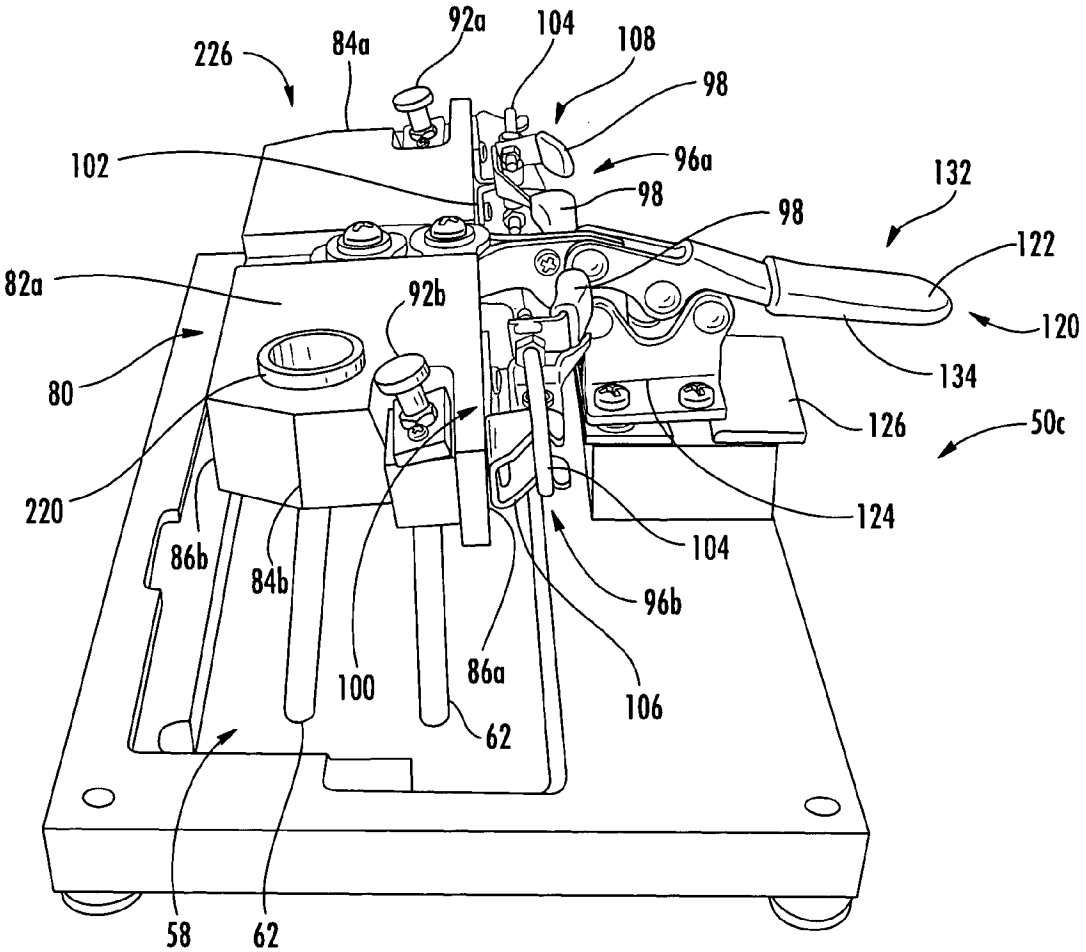
FIG. 10B is a right side perspective view of the device of FIG. 10A of the disclosure shown in a closed position.

As shown in FIGS. 10A-10B and FIGS. 11A-11B, there is provided in another embodiment a doctor blade alignment device 50*c* for aligning and positioning the doctor blade 40 (see FIG. 11A) in the toner hopper 12 (see FIG. 11A) of the toner printer cartridge 10*a* (see FIG. 1 A), 10*b* (see FIG. 2A) or another suitable toner printer cartridge. FIG. 10A is a front perspective view of the device 50*c* of the disclosure shown in an open position 224. FIG. 10B is a right side perspective view of the device 50*c* of FIG. 10A of the disclosure shown in a closed position 226.

Figure 11A:
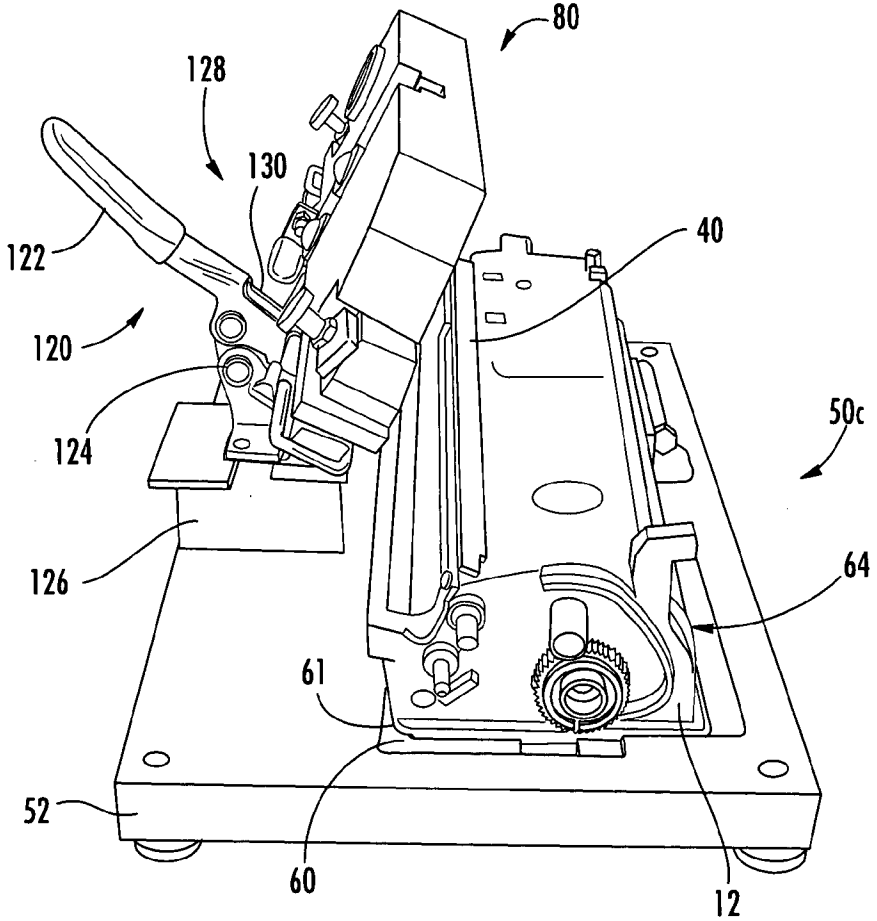
FIG. 11A is a left side perspective view of the device of FIG. 10A of the disclosure shown in an open position with a toner printer cartridge installed in the device.
Figure 11B:
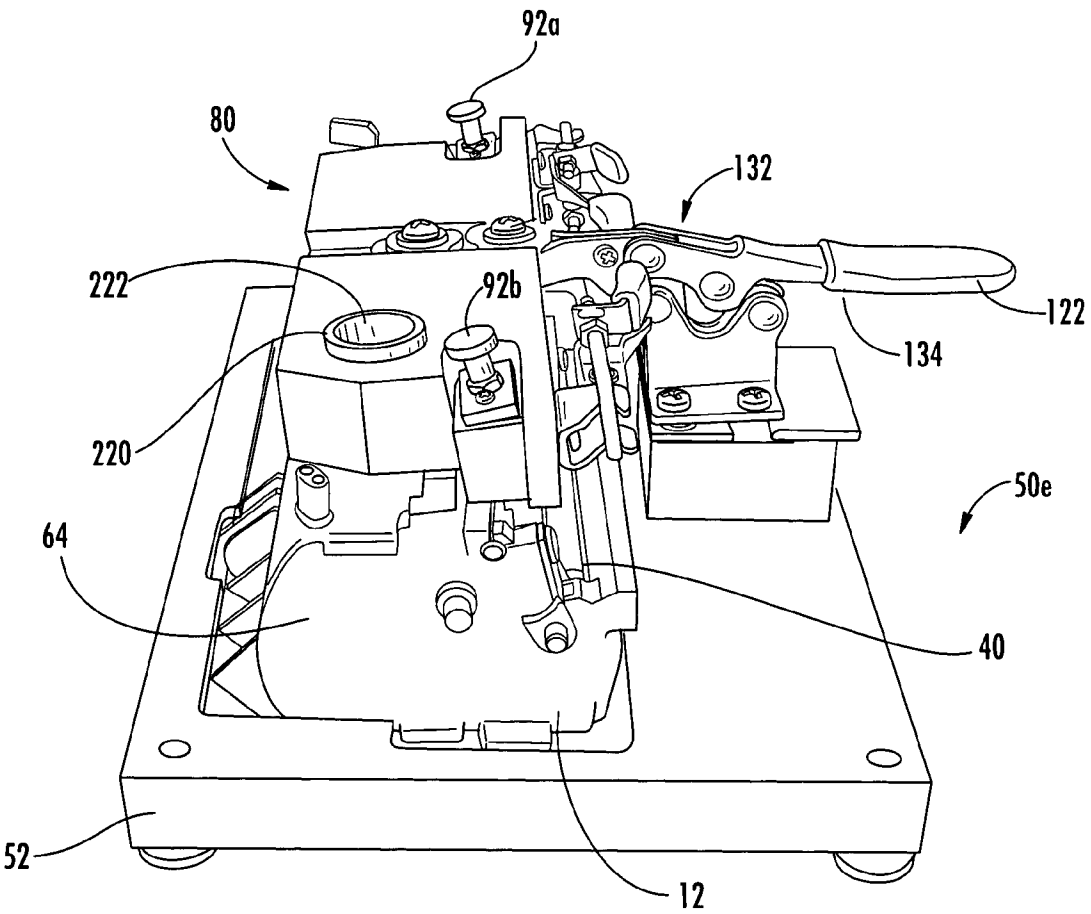
FIG. 11B is a right side perspective view of the device of FIG. 10A of the disclosure shown in a closed position with a toner printer cartridge installed in the device.

FIG. 11A is a left side perspective view of the device 50*c* of FIG. 10A of the disclosure shown in an open position 224 with a toner printer cartridge installed in the device 50*c*. FIG. 11B is a right side perspective view of the device 50*c* of FIG. 10A of the disclosure shown in a closed position 226 with a toner printer cartridge installed in the device 50*c*.

As shown in FIGS. 3A-3C, FIGS. 5A-5B, and FIGS. 10A-11B, embodiments of the doctor blade alignment device 50*a*, 50*b*, 50*c*, respectively, for aligning and positioning the doctor blade 40 in the toner hopper 12 of the toner printer cartridge 10*a* (see FIG. 1 A), 10*b* (see FIG. 2A) or another suitable toner printer cartridge are shown and comprise a base portion 52. As shown in FIGS. 3A, 4A, 5A, and 10A, the base portion 52 preferably has four sides 54*a*, 54*b*, 54*c*, 54*d* which form a planar platform. The base portion 52 further has a top surface 56*a* and a bottom surface 56*b*. The base portion 52 may be made of a durable plastic material, an acrylic material, or another suitable material.

As shown in FIGS. 3B, 4C, 5B, and 10A, the device 50*a*, 50*b*, 50*c* further comprises at least one cartridge portion holding element 58 on the base portion 52. The at least one cartridge portion holding element 58 preferably comprises an elongated cradle portion 60 (see FIG. 3B) on and formed in the top surface 56*a* of the base portion 52. The cradle portion 60 may be configured to retain a portion 61 (FIGS. 4B, 5B, 11A) of the toner hopper 12 (see FIG. 5B) or calibration toner hopper 12*a* (see FIG. 4C) in place on the device 50*a*, 50*b*, 50*c*. The cartridge portion holding element 58 comprising the cradle portion 60 may have one or more groove portions 62 (see FIGS. 4B, 10A) designed to generally correspond to the shape of a housing portion 61 of the toner hopper 12 or calibration toner hopper 12*a* (see FIG. 4C) of the toner printer cartridge 10*a* or 10*b* or a remanufactured toner printer cartridge 64 (see FIG. 11 B). Embodiments of the device 50*a*, 50*b* may further comprise additional cartridge portion holding elements 58, including two or more retaining projections 66*a*, 66*b* (see FIGS. 3A, 4C, 5A) coupled to and mounted on the first surface 56*a* of the base portion 52 and two or more retaining clamp assemblies 68*a*, 68*b* (see FIGS. 3A, 4C, 5B) coupled to and mounted on the first surface 56*a* of the base portion 52. The two or more retaining projections 68*a*, 68*b* may each have one or more cutout portions 70*a*, 70*b* (see FIGS. 3C, 4B, 5A) designed to hold and fit portions 72*a*, 72*b* (see FIGS. 4A, 4B, 5B) of the toner hopper 12 or calibration toner hopper 12*a* (see FIG. 4C) of the toner printer cartridge 10*a* or 10*b* or a remanufactured toner printer cartridge 64 (see FIG. 11B). The two or more retaining clamp assemblies 68*a*, 68*b* may each comprise a clamp portion 74*a*, 74*b* (see FIG. 3A) respectively, an attachment portion 76*a*, 76*b* (see FIG. 3A) respectively, and a press portion 78*a*, 78*b* (see FIG. 3A) respectively. The clamp portions 74*a*, 74*b* may comprise a plastic or rubber covered lever handle 73 (see FIG. 3A) and push rod 75 (see FIG. 3A). The attachment portions 76*a*, 76*b* may comprise a base piece 77 (see FIG. 3A) attached to the base portion 52 with fasteners 100 (see FIG. 3B) such as screws 102 (see FIG. 3B). The press portions 78*a*, 78*b* may comprise a rubber or plastic block having an opening 79 (see FIG. 3A) and a step portion 71 (see FIG. 3A). The opening 79 allows the push rod 75 to push through to make contact with and further hold and secure the toner hopper 12 or calibration toner hopper 12*a* retained in the cartridge portion holding element 58. The step portion 71 allows for further securement of the toner hopper 12 or calibration toner hopper 12*a* retained in the cartridge portion holding element 58. When the toner hopper 12 or calibration toner hopper 12*a* is retained in the cartridge portion holding element 58 and the clamp assemblies 68*a*, 68*b* are in a closed position 69 (see FIG. 4C), the press portions 78*a*, 78*b* are pushed against portions 67 (see FIG. 4C) of the toner hopper 12 or calibration toner hopper 12*a* (see FIG. 4C) to further secure and retain it in place. When the clamp assemblies 68*a*, 68*b* are in an open position 65 (see FIG. 5B), the press portions 78*a*, 78*b* are spaced away from the toner hopper 12 (see FIG. 5B) or calibration toner hopper 12*a*.

The cartridge portion holding elements 58, including the cradle portion 60, the retaining projections 66*a*, 66*b*, and the clamp assemblies 68*a*, 68*b* are preferably designed and configured to hold the toner hopper 12 or calibration toner hopper 12*a*, such that when the toner hopper 12 or calibration toner hopper 12*a* is laid or slid into and positioned onto the cartridge portion holding element 58 (see FIG. 4A), each of the retaining projections 66*a*, 66*b*, the clamp assemblies 68*a*, 68*b* and the cartridge portion holding element 58 cooperate to prevent the toner hopper 12 or calibration toner hopper 12*a* from moving forward, backward, or side-to-side relative to the base portion 52 and facilitate locking the toner hopper 12 or calibration toner hopper 12*a* into place in the device 50*a* (see FIG. 4C). It is noted that terms relating to spatial orientation, such as "forward," "backward," and "side-to-side" are used herein for ease and clarity of description only. The disclosure is not limited by these spatial orientations and may be practiced without observing the descriptions that use these spatial orientations.

The sizes, shapes, orientations, and positions of the cradle portion 60, the retaining projections 66*a*, 66*b*, and the clamp assemblies 68*a*, 68*b* may vary depending on the design of the toner hopper 12 or calibration toner hopper 12*a* or toner printer cartridge 10*a*, 10*b* or portions of the toner printer cartridge 10*a*, 10*b* or remanufactured toner printer cartridge 64 intended to be laid or slid into and positioned in embodiments of the device 50*a*, 50*b*, 50*c*. It can be realized the embodiments of the device 50*a*, 50*b*, 50*c* disclosed herein affix the toner hopper 12 or calibration toner hopper 12*a* or portions of the toner printer cartridge 10*a*, 10*b* or remanufactured toner printer cartridge 64 to a substantially steady position, which may be ideal for performing assembly, manufacturing or remanufacturing work on each of them, such as positioning and aligning a doctor blade, refilling with toner the toner hopper of the toner printer cartridge, sealing the toner printer cartridge with sealing elements, and other suitable assembly, manufacturing or remanufacturing work.

As shown in FIGS. 3A, 4A, 5A, 10A, the device 50*a*, 50*b*, 50*c* further comprises an alignment assembly portion 80 coupled to the base portion 52. The alignment assembly portion 80 has a body portion 81 (see FIG. 5A) having a first side 82*a* (see FIG. 5A), a second side 82*b* (see FIG. 5A), a first end 84*a* (see FIG. 5A), a second end 84*b* (see FIG. 5A), a top portion 86*a* (see FIG. 5A), and a bottom portion 86*b* (see FIG. 5A). The second side 82*b* of the alignment assembly portion 80 may have a lip portion 88 (see FIGS. 3B, 5B) that is designed to hold and fit a portion 89 (see FIG. 5B) of the toner hopper 12 (see FIG. 5B) or the calibration toner hopper 12*a* (see FIG. 4C) of the toner printer cartridge 10*a* or 10*b* or the remanufactured toner printer cartridge 64.

The alignment assembly portion 80 sets and calibrates a doctor blade alignment setting 90 (see FIG. 6) and aligns a doctor blade 40 (see FIGS. 5B, 11B) or a calibration doctor blade 40*a* (see FIG. 4C) in a toner hopper 12 or calibration toner hopper 12*a*, respectively, retained by the cartridge portion holding elements 58. Preferably, the doctor blade alignment setting 90 enables repeated alignment of subsequent doctor blades in toner hoppers of toner printer cartridges of a same model. Embodiments of the device 50*a*, 50*b*, 50*c* may be used to align doctor blades 40 in toner hoppers 12 of assembled or remanufactured toner printer cartridges to maximize printing quality of the assembled or remanufactured toner printer cartridges when used in a known laser printing device (not shown). Further, embodiments of the device 50*a*, 50*b*, 50*c* may be used to align a calibration doctor blade 40*a* (see FIG. 4C) in a calibration toner hopper 12*a* (see FIG. 4C) in order to calibrate the device 50*a*, 50*b*, or 50*c*.

Figure 6:
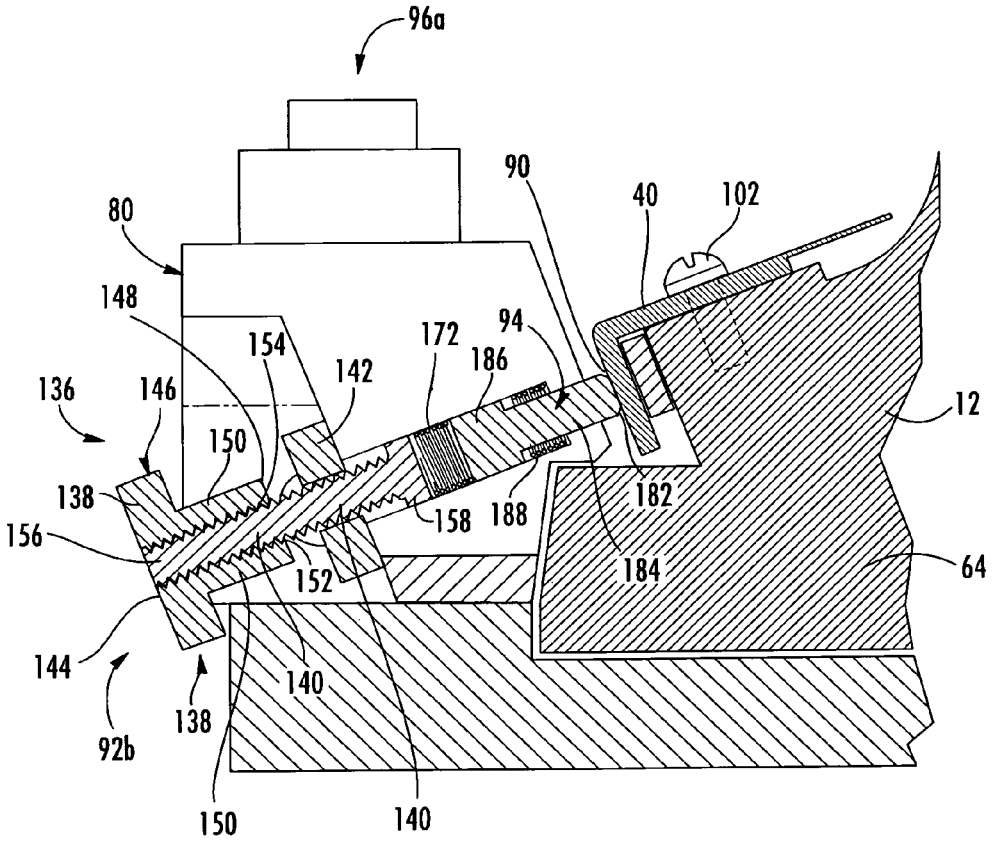
FIG. 6 is an illustration of a cross-sectional view of one of the embodiments of a positioning pin assembly in use with a doctor blade of a toner hopper of one of the embodiments of a device disclosed herein.

As shown in FIGS. 3C, 5BC, 11B, the alignment assembly portion 80 comprises at least two positioning pin assemblies 92*a*, 92*b* each having a positioning pin 94 (see FIGS. 6, 8A) configured to contact the doctor blade 40 or calibration doctor blade 40*a* in the toner hopper 12 or calibration toner hopper 12*a*, respectively, retained by the cartridge portion holding element 58 in order to set the doctor blade alignment setting 90 (see FIG. 6). The alignment assembly portion 80 further comprises at least two clamp assemblies 96*a*, 96*b* (see FIGS. 3C, 5B, 10B) each locking the positioning pin 94 in place at the doctor blade alignment setting 90.

As shown in FIGS. 3C, 5B, each of the clamp assemblies 96*a*, 96*b* may be mounted on the top portion 86*a* of the alignment assembly portion 80. Each of the clamp assemblies 96*a*, 96*b* preferably comprises one or more locking clamps 98 (see FIGS. 3C, 5B). For example, as shown in FIG. 3C, each clamp assembly 96*a*, 96*b* of the embodiment of the device 50*a* comprises two locking clamps 98 for a total of four locking clamps 98 of the alignment assembly portion 80. For example, as shown in FIG. 5B, each clamp assembly 96*a*, 96*b* of the embodiment of the device 50*b* comprises one locking clamp 98 for a total of two locking clamps 98 of the alignment assembly portion 80. For example, as shown in FIG. 10B, each clamp assembly 96*a*, 96*b* of the embodiment of the device 50*c* comprises two locking clamps 98 for a total of four locking clamps 98 of the alignment assembly portion 80. Alternatively, the alignment assembly portion 80 may comprise another suitable number of clamps 98. Each clamp assembly 96*a*, 96*b* may be mounted to the top portion 86*a* of the alignment assembly portion 80 using fasteners 100, such as screws 102 (see FIGS. 3C, 5B, 10B) or another suitable fastener, known in the art. As shown in FIG. 3C, each of the clamp assemblies 96*a*, 96*b* preferably further comprises a hook portion 104 for hooking to a corresponding latch portion 106 in order to lock the locking clamp 98. FIG. 3C shows the hook portion 104 and the locking clamps 98 moved upwardly such that the clamp assembly 96*a*, 96*b* is in an open position 110. FIGS. 3B, 5A show the hook portion 104 and the locking clamps 98 moved downwardly such that the clamp assembly 96*a*, 96*b* is in a closed position 108.

The alignment assembly portion 80 further comprises two or more cut slots 112*a*, 112*b* (see FIGS. 3B, 5A, 10A) in the body portion 81 of the alignment assembly portion 80. The cut slots 112*a*, 112*b* act to separate portions 114*a*, 114*b* (see FIGS. 3B, 5A, 10A) from portion 116 (see FIGS. 3B, 5A, 10A) of the body portion 81 of the alignment assembly portion 80. Openings 118*a*, 118*b* (see FIGS. 3B, 10A) are formed between the separate portions 114*a*, 114*b* and portion 116 and at the cut slots 112*a*, 112*b*. The openings 118*a*, 118*b* are configured to provide a through opening for positioning pins 94 (see FIGS. 3B, 6) to contact the doctor blade 40 of the toner hopper 12. When the clamp assemblies 96*a*, 96*b* are moved from an open position 110 to a closed or locked position 108, each locking clamp 98 pulls together the separate portions 114*a*, 114*b* and the portion 116 so that they lock together around the positioning pins 94 in the openings 118*a*, 118*b*. The positioning pins 94 are preferably locked in place at the doctor blade alignment setting 90 (see FIG. 6).

Figure 7:
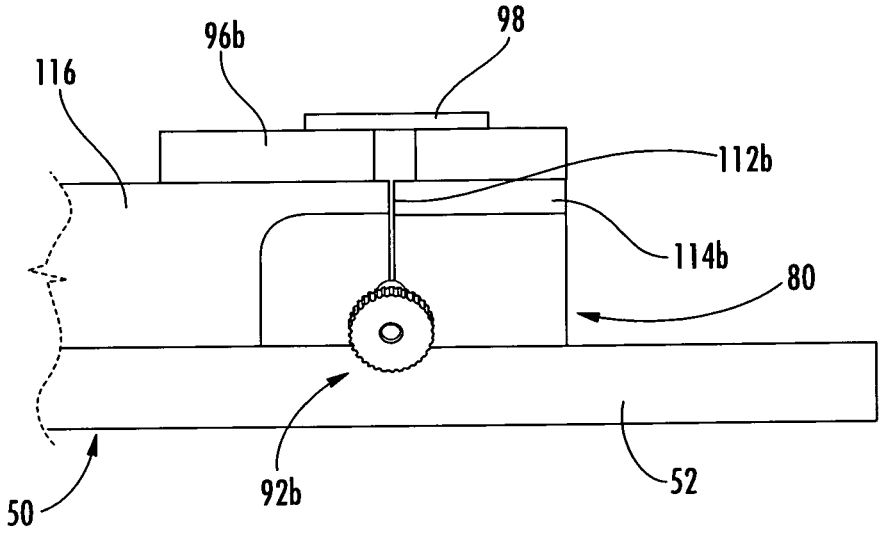
FIG. 7 is an illustration of a front view of a cut slot of the alignment assembly portion of one of the embodiments of the device disclosed herein.

FIG. 7 is an illustration of a front view of the cut slot 112*b*, the portion 114*b* and portion 116 of the alignment assembly portion 80, the clamp assembly 96*b* and locking clamp 98, and the positioning pin assembly 92*b* of one embodiment of a portion of the doctor blade alignment device 50.

As shown in FIGS. 10A-11B, the alignment assembly portion 80 further comprises in the embodiment of the device 50*c* a handle clamp assembly 120 (see FIGS. 10B, 11A). As shown in FIG. 11A, the handle clamp assembly 120 may comprise a handle 122 attached to a pivot portion 124 which is attached to a clamp base portion 126. The clamp base portion 124 is coupled to or attached to the top surface 56*a* of the base portion 52. The handle clamp assembly 120 is attached to and integral with the alignment assembly portion 80. As shown in FIG. 11A, the handle clamp assembly 120 is in an open position 128 and the handle 122 is at an angled position 130 relative to the base portion 52. When the handle 122 is moved from an open position 128 to a closed position 132 (see FIG. 11B), the handle is at a substantially parallel position 134 relative to the base portion 52. When the handle 122 is moved from the substantially parallel position 134 to the angled position 130 and vice verse, the handle 122 preferably pivots around the pivot portion 124.

Figure 8A:
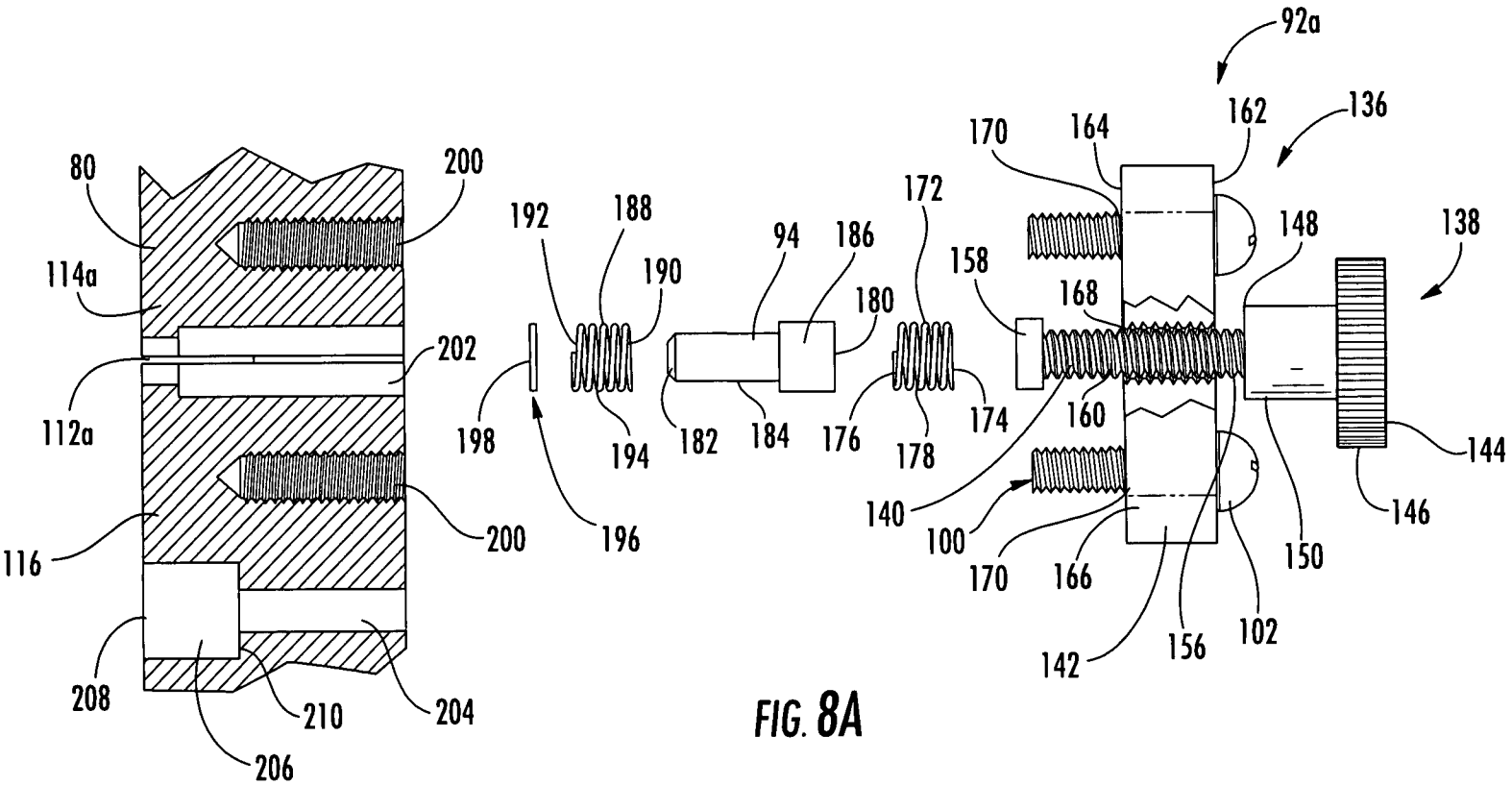
FIG. 8A is an illustration of a cross-sectional exploded view of one of the embodiments of a positioning pin assembly of one of the embodiments of a device disclosed herein used with a magnet element.
Figure 8B:
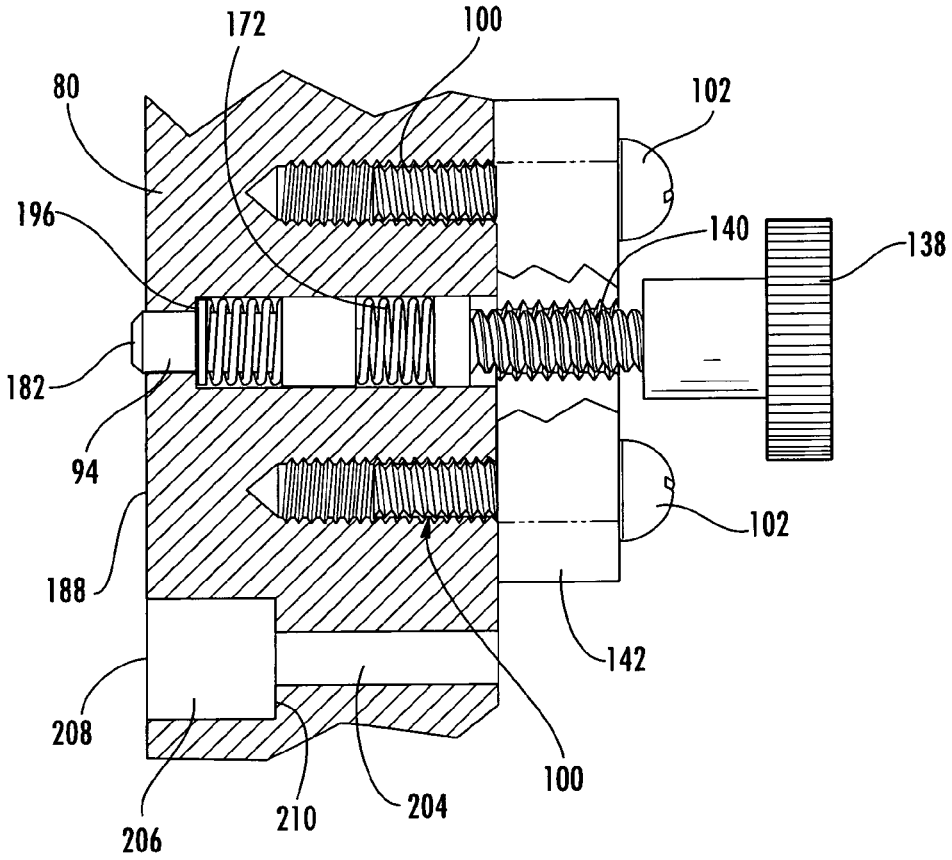
FIG. 8B is an illustration of a cross-sectional view of the positioning pin assembly of FIG. 8A where the positioning pin assembly is assembled.

FIG. 6 is an illustration of a cross-sectional view of one of the embodiments of the positioning pin assembly 92*b* in use with a doctor blade 40 of a remanufactured printer cartridge 64. FIG. 8A is an illustration of a cross-sectional exploded view of one of the embodiments of the positioning pin assembly 92*a* used with a magnet element 206 where the positioning pin assembly 92*b* is unassembled. FIG. 8B is an illustration of a cross-sectional view of the positioning pin assembly 92*b* of FIG. 8A where the positioning pin assembly 92*b* is assembled.

As shown in FIGS. 6, 8A, the at least two positioning pin assemblies 92*a*, 92*b* of the alignment assembly portion 80 each comprise a positioning pin 94 configured to contact a doctor blade 40 in a toner hopper 12 or a calibration doctor blade 40*a* in a calibration toner hopper 12*a* of a toner printer cartridge 10*a*, 10*b* or another suitable toner printer cartridge when the toner hopper 12 or calibration toner hopper 12*a* is retained by or in the cartridge portion holding assembly 58 in order to obtain a doctor blade alignment setting 90 (see FIG. 6) of the doctor blade 40 or calibration doctor blade 40*a*. The positioning pin assemblies 92*a*, 92*b* set the desired doctor blade alignment setting 90 of the doctor blade 40 in the toner hopper 12 to enable repeated alignment of subsequent doctor blades in toner hoppers of toner printer cartridges of a same or similar model or used in a same or similar printer engine.

As shown in FIGS. 6, 8A, the positioning pin assembly 92*a*, 92*b* comprises a knob subassembly 136. The knob subassembly 136 may comprise a knob portion 138, a threaded push rod 140, and a threaded plate portion 142. The knob portion 138 may comprise a first end 144 having a head portion 146. The head portion 146 facilitates turning or rotating of the knob portion 138 by an assembler or user. The knob portion 138 may further comprise a second end 148 and a body portion 150. The second end 148 may have a threaded through opening 152 through an interior threaded portion 154 of the body portion 150. The head portion 146 may be connected to or integral with the body portion 150. The threaded push rod 140 may comprise a first end 156, a second end 158, and an elongated body 160. The threaded plate portion 142 may comprise a first end 162, a second end 164, and a cylindrical body 166 having a central threaded through opening 168 and one or more side threaded through openings 170 for receiving one or more fasteners 100, such as screws 102, for attachment to the alignment assembly portion 80.

When assembled, the first end 156 of the threaded push rod 140 may initially be inserted into the threaded through opening 168 of the threaded plate portion 142. The first end 156 of the threaded push rod 140 may then be inserted into the threaded through opening 152 of the knob portion 138 and through the interior threaded portion 154 of the body portion 150 of the knob portion 138.

As shown in FIGS. 6, 8A, the positioning pin assembly 92*a*, 92*b* may further comprise a first compression spring 172 having a first end 174, a second end 176, and a first spring body 178. When assembled, the first end 174 of the first compression spring 172 may be adjacent to the second end 158 of the threaded push rod 140. When assembled, the second end 176 of the first compression spring 172 may be adjacent to a first end 180 of the positioning pin 94. The positioning pin 94 may further comprise a second end 182 and an elongated pin body 184. The first end 180 of the positioning pin 94 may comprise a pin head 186. As shown in FIGS. 6, 8A, the positioning pin assembly 92*a*, 92*b* may further comprise a second compression spring 188 having a first end 190, a second end 192, and a second spring body 194. When assembled, the second compression spring 188 may surround a portion of the pin body 184 of the positioning pin 94. As shown in FIG. 8A, the positioning pin assembly 92*a*, 92*b* may further comprise a washer or shim piece 196 having a central opening 198 for insertion of the pin body 184 of the positioning pin 94 when assembled.

As shown in FIGS. 8A, 8B, the alignment assembly portion 80 may further comprise two or more threaded openings 200 for receiving the fasteners 100, such as screws 102, that are threaded through the threaded plate portion 142. The fasteners 100 are inserted and tightened into the threaded openings 200 in order to attach the positioning pin assemblies 92*a*, 92*b* to the alignment assembly portion 80. The alignment assembly portion 80 may further comprise a through opening 202 (see FIG. 8A) formed along all or a portion of the cut slot 112*a* between portion 114*a* and portion 116 of the alignment assembly portion 80. The through opening 202 is configured to receive the positioning pin 94 such that the second end 182 of the positioning pin 94 is in contact with a doctor blade 40 or calibration doctor blade 40*a* during the process of aligning the doctor blade.

As shown in FIGS. 8A, 8B, the alignment assembly portion 80 may further comprise at least two openings 204 configured to house at least two magnet elements 206 positioned in the alignment assembly portion 80. The magnet elements 206 have a first end 208 and a second end 210 and may be any suitable shape. The magnet elements 206 preferably are of a magnetic strength so as to pull and hold the metal portion of the doctor blade in place against the alignment assembly portion when in use. As shown in FIG. 3B, the magnet elements 206 are exposed at the first end 208 and are positioned flush with the second side 82*b* of the alignment assembly portion 80. The magnet elements 206 are preferably positioned near the positioning pin 94. The magnet elements 206 are preferably configured to contact the doctor blade 40 in the toner hopper 12 retained in the cartridge portion holding assembly 58 and configured to sufficiently hold the doctor blade 40 or calibration doctor blade 40*a* in place during alignment and calibration of the doctor blade 40 or calibration doctor blade 40*a*, respectively.

In one embodiment as shown in FIGS. 3A-3C, the device 50*a* may further comprise a doctor blade press assembly 212 coupled to the base portion 52. As shown in FIG. 3B, the doctor blade press assembly 212 may comprise a handle 214, a pivot portion 216, and a clamp base portion 218. The doctor blade press assembly 212 may be used to apply pressure to the doctor blade 40 to position the doctor blade 40 adjacent a developer roller 36 (see FIG. 1B) in the toner hopper 12 of the toner printer cartridge 10*a*, 10*b* or the doctor blade press assembly 212 may be used to press and install a sealing element (not shown) in the toner hopper 12. The doctor blade press assembly 212 is an additional feature of the device 50*a*.

As shown in FIGS. 3C, 11B, the device 50*a*, 50*c* may further comprise a guide element 220. The guide element 220 may have a cylindrical shape with a central through opening 222 for receiving a drill (not shown) or other device for opening a hole through the toner hopper 12 in order to fill or refill the toner hopper 12 with toner (not shown). The guide element 220 is preferably configured to serve as a template for creating a toner refill hole in the toner hopper 12 to allow toner refilling of the toner hopper 12 of the toner printer cartridge 10*a*, 10*b* or another suitable toner printer cartridge that is retained in the device 50*a*, 50*b*, 50*c*. In one embodiment, as shown in FIG. 3C, the guide element 220 may be coupled to the retaining projection 66*b*. In another embodiment, as shown in FIG. 11B, the guide element 220 may be coupled to the alignment assembly portion 80.

Figure 12:
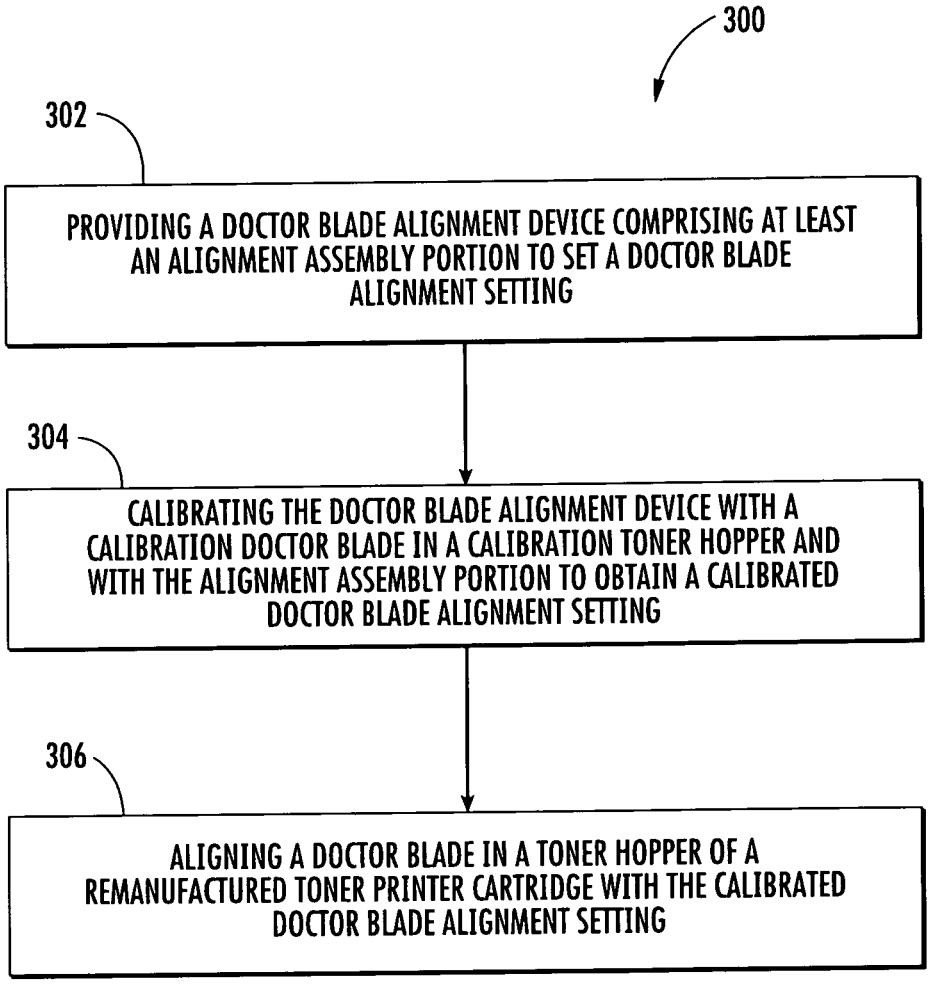
FIG. 12 is an illustration of a flow diagram of one of the embodiments of a method of the disclosure; and, FIG. 13 is an illustration of a flow diagram of another one of the embodiments of a method of the disclosure.

There is also provided a method 300 of aligning a doctor blade 40. FIG. 12 is an illustration of a flow diagram of one of the embodiments of the method 300 for aligning the doctor blade 40 in a toner hopper 12 (see FIG. 11 A) of a remanufactured toner printer cartridge 64 (see FIG. 11A) using one of the embodiments of a device 50*a*, 50*b* or 50*c*, as discussed in detail above. The method 300 comprises step 302 of providing a doctor blade alignment device 50*a*, 50*b*, 50*c* comprising at least an alignment assembly portion 80 configured to set a doctor blade alignment setting 90 (see FIG. 6). The method 300 further comprises step 304 of calibrating the doctor blade alignment device 50*a*, 50*b*, or 50*c* with a calibration doctor blade 40*a* (see FIG. 4C) in a calibration toner hopper 12*a* (see FIG. 4C) and with the alignment assembly portion 80 to obtain a calibrated doctor blade alignment setting 90*a* (see FIG. 4C). The method 300 may further comprise prior to the calibrating the doctor blade alignment device step 302, the step of coupling a pin setting element 230 (see FIGS. 9A-9B) to each of the first end 42*a* and the second end 42*b* (see FIG. 9A) of the calibration doctor blade 40*a*.

The method 300 further comprises step 306 of aligning a doctor blade 40 in a toner hopper 12 of a remanufactured toner printer cartridge 64 with the calibrated doctor blade alignment setting 90*a*. The method 300 may further comprise after the aligning the doctor blade step 306, the step of repeatedly aligning subsequent doctor blades in toner hoppers of toner printer cartridges of a same model. The alignment assembly portion of the doctor blade alignment device 50*a*, 50*b*, 50*c* comprises at least two positioning pin assemblies 92*a*, 92*b* (see FIGS. 3C, 8A) each having a positioning pin 94 configured to contact the calibration doctor blade 40*a* or the doctor blade 40 in order to set the calibration doctor blade alignment setting 90*a* or the doctor blade alignment setting 90. The alignment assembly portion 80 of the doctor blade alignment device 50*a*, 50*b*, 50*c* further comprises at least two clamp assemblies 96*a*, 96*b* each locking the positioning pin 94 in place at the doctor blade alignment setting 90. The method 300 may further comprise prior to calibrating the doctor blade alignment device, coupling at least two magnet elements 206 (see FIG. 8A) to the alignment assembly portion where the magnet elements 206 are configured to contact the doctor blade in the toner hopper retained by a cartridge portion holding element. The method 300 preferably aligns doctor blades in remanufactured toner printer cartridges to maximize printing quality of the remanufactured toner printer cartridges when used in a laser printing device.

Figure 13:
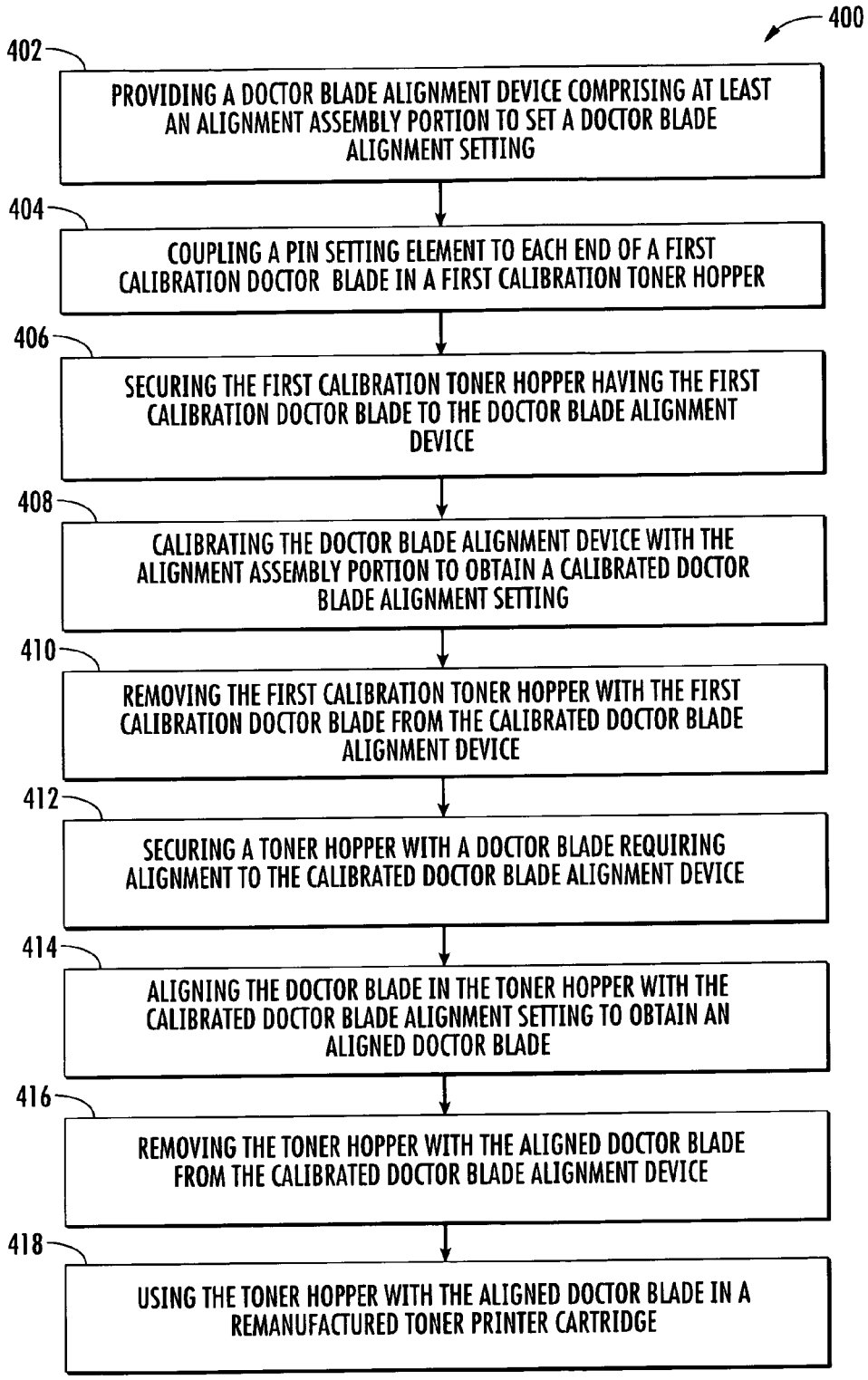

FIG. 13 a flow diagram of one of the embodiments of a method 400 of remanufacturing a toner printer cartridge where the toner printer cartridge has a toner hopper 12 with a doctor blade 40. The method 400 comprises the step 402 of providing a doctor blade alignment device 50*a*, 50*b*, 50*c*, as discussed in detail above, comprising at least an alignment assembly portion 80 to set a doctor blade alignment setting 90. The method 400 further comprises the step 404 of coupling a pin setting element 230 (see FIG. 9B) to each end of a first calibration doctor blade 40*a* in a first calibration toner hopper 12*a* (see FIG. 4C). The method 400 further comprises the step 406 of securing the first calibration toner hopper 12*a* having the first calibration doctor blade 40*a* to the doctor blade alignment device 50*a*, 50*b*, 50*c*. The method 400 further comprises the step 408 of calibrating the doctor blade alignment device 50*a*, 50*b*, 50*c* with the alignment assembly portion 80 to obtain a calibrated doctor blade alignment setting 90*a*. The method 400 further comprises the step 410 of removing the first calibration toner hopper 12*a* with the first calibration doctor blade 40*a* from the doctor blade alignment device 50*a*, 50*b*, 50*c* that has been calibrated.

The method 400 further comprises the step 412 of securing a toner hopper 12 with a doctor blade 40 requiring alignment to the doctor blade alignment device 50*a*, 50*b*, 50*c* that has been calibrated. Preferably, the doctor blade 40 has loosened fasteners 100 and is in a floating, loosened position with respect to the toner hopper 12. Preferably, the doctor blade 40 is adjacent the alignment assembly portion 72. The method 400 further comprises the step 414 of aligning the doctor blade 40 in the toner hopper 12 with the calibrated doctor blade alignment setting 90*a* (see FIG. 4C) to obtain an aligned doctor blade 40. The positioning pins 94 of the alignment assembly portion 72 are preferably in contact with the doctor blade 40 and the magnet elements 206, if present, draw or pull the doctor blade 40, which is typically made of a metal material, to the alignment assembly portion 80 and in particular, to the positioning pins 94. The method 400 further comprises the step 416 of removing the toner hopper 12 with the aligned doctor blade 40 from the calibrated doctor blade alignment device 50*a*, 50*b*, 50*c*. The method 400 further comprises the step 418 of using the toner hopper 12 with the aligned doctor blade 40 in a remanufactured toner printer cartridge 64.

The method 400 may further comprise after the step 418 of using the toner hopper 12 with the aligned doctor blade step in a remanufactured toner printer cartridge 64 (see FIG. 11A), the step of repeating the aligning, removing and using steps with subsequent doctor blades in toner hoppers of remanufactured toner printer cartridges of a same model. The method 400 may further comprise after the step 418 of using the toner hopper 12 with the aligned doctor blade step in a remanufactured toner printer cartridge 64, the step of re-calibrating the doctor blade alignment device 50*a* or 50*b* with a second calibration toner hopper 12*b* (see FIG. 3A) having a second calibration doctor blade 40*b* (see FIG. 3A).

Figure 9A:
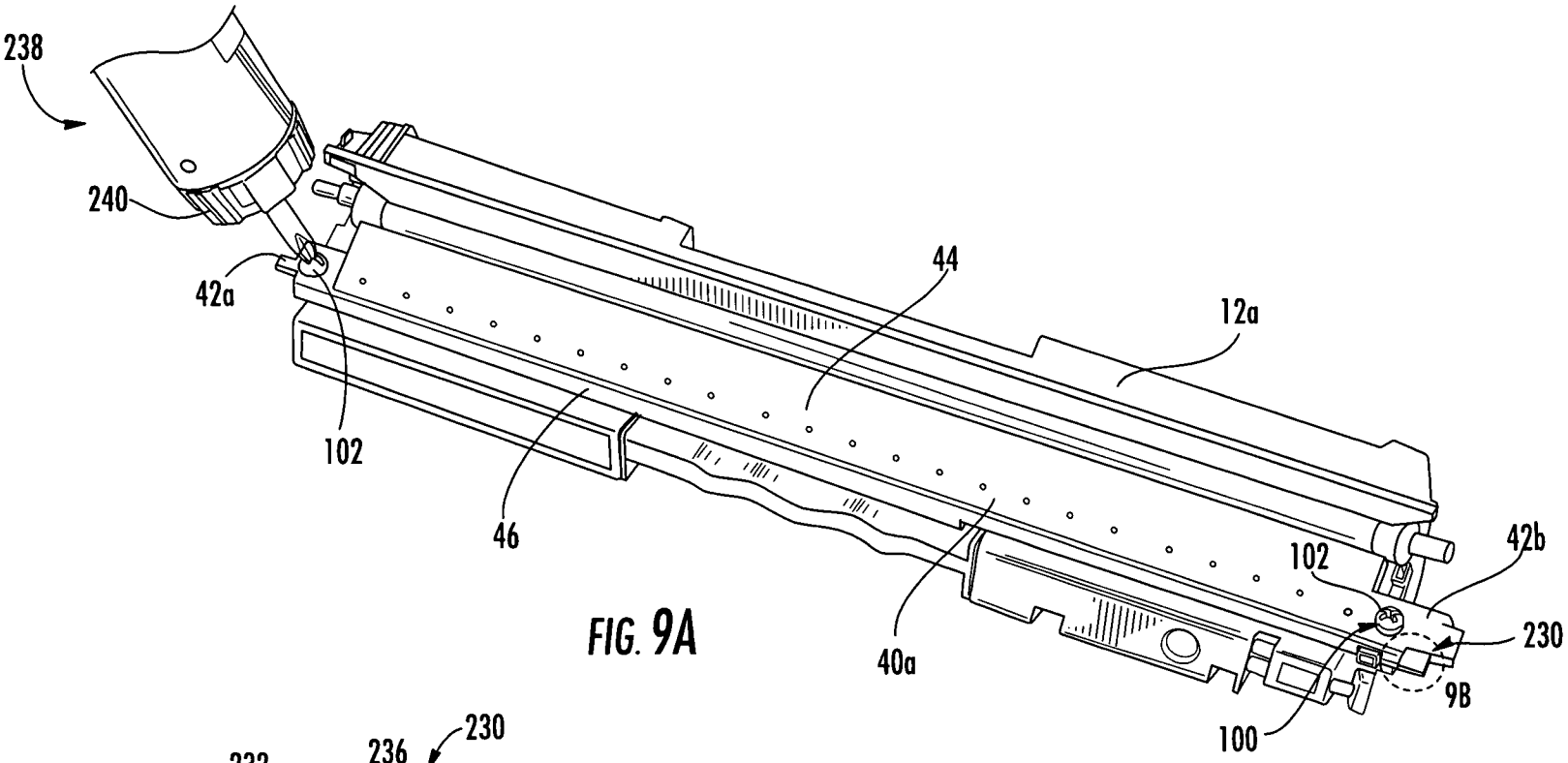
FIG. 9A is a top perspective view of a pin setting element used in one of the embodiments of a method of the disclosure.
Figure 9B:
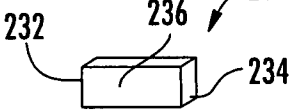
FIG. 9B is an illustration of one of the embodiments of a pin setting element used in one of the embodiments of a method of the disclosure.

FIG. 9A is a top perspective view of one of the embodiments of a pin setting element 230 used in one of the embodiments of a method 300, 400 of the disclosure. The fastener 100, such as a screw 102, that attaches the doctor blade 40*a*, is loosened when the pin setting element 230 is attached to a calibration doctor blade 40*a*. FIG. 9B is an illustration of one of the embodiments of the pin setting element 230 used in one of the embodiments of a method 300, 400 of the disclosure. The pin setting element 230 may comprise a first end 232 and a second end 234. The first end 232 of the pin setting elements 230 may be coupled to the first end 42*a* and the second end 42*b*, respectively, of the calibration doctor blade 40*a*. Once the pin setting elements 230 are coupled to the calibration doctor blade 40*a*, a fastener tightening device 238 (see FIG. 9A), such as a screwdriver 240 (see FIG. 9A), may be used to tighten the fasteners 100, such as screws 102, on each end of the calibration doctor blade 40*a* to secure the doctor blade 40*a* and the pin setting elements 230 in place prior to use in the device 50*a*, 50*b*, 50*c* for calibrating the device 50*a*, 50*b*, 50*c*. The calibration toner hopper 12*a* with the calibration doctor blade 40*a* and pin setting elements 230 may be used in the device 50*a*, 50*b*, 50*c* with one of the methods 300, 400 disclosed herein.

Using the calibration doctor blade 40*a* in the calibration toner hopper 12*a* to calibrate the device 50*a*, 50*b*, 50*c* has been calibrated, a doctor blade 40 in a toner hopper 12 for a remanufactured toner printer cartridge 64 may be aligned with the device 50*a*, 50*b*, 50*c* that has been calibrated. The calibration toner hopper 12*a* is preferably installed on the device 50*a*, 50*b*, or 50*c* by sliding or setting the calibration toner hopper 12*a* in the cartridge portion holding element 58, such as the cradle portion 60, so that the calibration doctor blade 40*a* is facing the alignment assembly portion 80. For device 50*a*, 50*b*, the calibration toner hopper 12*a* may be secured with the cradle portion 60, the retaining projections 66*a*, 66*b*, and the clamp retaining assemblies 68*a*, 68*b*. For device 50*c*, the calibration toner hopper 12*a* may be secured with the cradle portion 60 and the clamp assemblies 96*a*, 96*b*. Once the calibration toner hopper 12*a* is secured in the device 50*a*, 50*b*, or 50*c*, each knob portion 138 of the positioning pin assembly 92*a*, 92*b* may be turned or rotated clockwise until the knob portion 138 stops turning. This means that each positioning pin 94 has moved and is set into place against the calibration doctor blade 40*a*. Then each locking clamp 98 of the clamp assemblies 96*a*, 96*b* is preferably locked to lock each positioning pin 94 in place. The doctor blade alignment setting 90 has then preferably been set. The calibration toner hopper 12*a* with the calibration doctor blade 40*a* may then be removed from the device 50*a*, 50*b*, 50*c*. A toner hopper 12 having a doctor blade 12 that needs to be aligned and that has its fasteners 100 or screws 102 loosened, can then be installed and secured in the device 50*a*, 50*b*, 50*c* that has been calibrated. The doctor blade 40 may be aligned with the device 50*a*, 50*b*, 50*c* that has been calibrated by contacting and drawing the doctor blade 40 against the set and calibrated positioning pins 94. The magnet elements 206 may be used to hold the doctor blade 40 in place while the fasteners 100 or screws 102 are then tightened with a fastener tightening device 239 or screwdriver 240. Once the doctor blade 40 has been aligned, the toner hopper 12 with aligned doctor blade 40 may be removed from the device 50*a*, 50*b*, 50*c* for use in a remanufactured toner printer cartridge 64. The calibrated device 50*a*, 50*b*, 50*c* may be used to align numerous subsequent doctor blades in toner hoppers of remanufactured toner printer cartridges or cartridges of a same or similar model.

It can now be realized that the device 50 (50*a*, 50*b*, 50*c*) and methods 300, 400 disclosed herein provide numerous advantages over known devices and methods, including but not limited to the following: provides a device that may effectively hold a toner printer cartridge portion or an entire toner printer cartridge during assembly, manufacture, remanufacture, toner refill, refurbishment, repair, maintenance, or doctor blade alignment, resulting in an assembler or user being able to work efficiently and quickly; provides a device and method that effectively aligns and positions the doctor blade with respect to the toner hopper and proximate to the developer roller or mag roller during assembly, manufacture, and remanufacture, which may be beneficial in allowing the doctor blade to regulate the toner amount on the developer roller or mag roller, and which may result in maximizing print quality during printing; provides a device and method that in one embodiment uses an alignment assembly portion with magnet elements to draw the doctor blade firmly against the positioning pins, which may eliminate or minimize the need for an assembler or user to manually hold the doctor blade in order to tighten the fasteners to secure the doctor blade to the toner hopper; provides a device and method that may eliminate assembler or user mishandling, minimize rejected parts, and decrease assembly, manufacture, or remanufacture time; provides a device and method that does not require the use of permanently attached spacers, inserts, shims, or other spacing elements which may increase the overall cost and complexity and decrease the overall efficiency of the assembly, manufacturing, or remanufacturing processes; provides a method and device that aligns and positions a doctor blade within a toner hopper or a portion of a remanufactured toner printer cartridge to maximize printing quality of the remanufactured toner printer cartridge when it is in use with a laser printer device (not shown); provides a device that has multiple uses in addition to doctor blade alignment and installation, including providing a press assembly for sealing and a guide for hole drilling for refilling the cartridge, such as a template for creating a refill hole on a toner hopper, which may allow for an efficient toner refill procedure; provides a device and method that aligns and positions the doctor blade during replacement and remanufacture accurately and efficiently to an acceptable alignment or position point to maximize print quality during printing; provides a device and method that may only require a one time setting to set a doctor blade alignment setting, thus increasing efficiency and decreasing cost; and provides a method and device that provides magnet elements located near the positioning pins to facilitate holding the doctor blade in place and to attract the metallic doctor blade and keep it uniformly aligned during the doctor blade installation and alignment, thus allowing an assembler or user to freely align and mount and attach hands free the doctor blade with tightening the fasteners or screws; provides a method and device having unique positioning pins driven by threaded push rods and special compression springs in order to apply constant force during calibration of the device; and provides a device and method that eliminates assembler mishandling, minimizes rejected parts and decreases assembly time.

Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting. Although specific terms are employed herein, they are used in a generic and descriptive sense only and for purposes of limitation. The invention is not limited in its application to the details of the construction and to the arrangement of the components set forth in the above description or as illustrated in the drawings.

What is claimed is:

1. A device for aligning a doctor blade in a toner hopper of a toner printer cartridge, the device comprising:

a base portion;

at least one cartridge portion holding element on the base portion; and, an alignment assembly portion setting a doctor blade alignment setting and aligning a doctor blade in a toner hopper retained by the cartridge portion holding element, the alignment assembly portion comprising at least two positioning pin assemblies each having a positioning pin configured to contact the doctor blade in the toner hopper retained by the cartridge portion holding element in order to set the doctor blade alignment setting, and at least two clamp assemblies each locking the positioning pin in place at the doctor blade alignment setting.

2. The device of claim 1 wherein the doctor blade alignment setting enables repeated alignment of subsequent doctor blades in toner hoppers of toner printer cartridges of a same model.

3. The device of claim 1 wherein the positioning pin assembly comprises:

a knob subassembly comprising a knob, a threaded push rod, and a plate portion;

a first compression spring coupled at a first end to the knob subassembly;

a positioning pin coupled to a second end of the first compression spring;

a second compression spring coupled to the positioning pin; and, at least two fastener elements for attaching the positioning pin assembly to the alignment assembly portion.

4. The device of claim 1 wherein the at least one cartridge portion holding element comprises a cradle portion configured to retain the toner hopper in place on the device.

5. The device of claim 1 further comprising at least two magnet elements coupled to the alignment assembly portion, the magnet elements configured to contact the doctor blade in the toner hopper retained by the cartridge portion holding element.

6. The device of claim 1 further comprising a doctor blade press assembly coupled to the base portion, the doctor blade press assembly applying pressure to the doctor blade to position the doctor blade adjacent a developer roller in the toner hopper of the toner printer cartridge or to press a sealing element against the doctor blade.

7. The device of claim 1 further comprising a guide element coupled to a portion of the device, the guide element configured to allow toner refilling of the toner hopper of the toner printer cartridge.

8. The device of claim 1 wherein the device is used to align doctor blades in remanufactured toner printer cartridges to maximize printing quality of the remanufactured toner printer cartridges when used in a laser printing device.

9. The device of claim 1 wherein the device is used to align a calibration doctor blade in a calibration toner hopper in order to calibrate the device.

10. A method for aligning a doctor blade in a toner hopper of a remanufactured toner printer cartridge, the method comprising:

providing a doctor blade alignment device comprising at least an alignment assembly portion to set a doctor blade alignment setting, wherein the alignment assembly portion comprises at least two positioning pin assemblies each having a positioning pin configured to contact the calibration doctor blade or the doctor blade in order to set the doctor blade alignment setting, and at least two clamp assemblies each locking the positioning pin in place at the doctor blade alignment setting;

calibrating the doctor blade alignment device with a calibration doctor blade in a calibration toner hopper and with the alignment assembly portion to obtain a calibrated doctor blade alignment setting; and, aligning a doctor blade in a toner hopper of a remanufactured toner printer cartridge with the calibrated doctor blade alignment setting.

11. The method of claim 10 further comprising prior to calibrating the doctor blade alignment device, coupling a pin setting element to each end of the calibration doctor blade.

12. The method of claim 10 further comprising prior to calibrating the doctor blade alignment device, coupling at least two magnet elements to the alignment assembly portion, the magnet elements configured to contact the doctor blade in the toner hopper retained by a cartridge portion holding element.

13. The method of claim 10 further comprising after aligning the doctor blade, repeatedly aligning subsequent doctor blades in toner hoppers of toner printer cartridges of a same model.

14. The method of claim 10 wherein the method aligns doctor blades in remanufactured toner printer cartridges to maximize printing quality of the remanufactured toner printer cartridges when used in a laser printing device.

15. A method of remanufacturing a toner printer cartridge, the toner printer cartridge having a toner hopper with a doctor blade, the method comprising the steps of:

providing a doctor blade alignment device comprising at least an alignment assembly portion to set a doctor blade alignment setting;

coupling a pin setting element to each end of a first calibration doctor blade in a first calibration toner hopper;

securing the first calibration toner hopper having the first calibration doctor blade to the doctor blade alignment device;

calibrating the doctor blade alignment device with the alignment assembly portion to obtain a calibrated doctor blade alignment setting;

removing the first calibration toner hopper with the first calibration doctor blade from the calibrated doctor blade alignment device;

securing a toner hopper with a doctor blade requiring alignment to the calibrated doctor blade alignment device;

aligning the doctor blade in the toner hopper with the calibrated doctor blade alignment setting to obtain an aligned doctor blade;

removing the toner hopper with the aligned doctor blade from the calibrated doctor blade alignment device; and, using the toner hopper with the aligned doctor blade in a remanufactured toner printer cartridge.

16. The method of claim 15 further comprising after the using the toner hopper with the aligned doctor blade step, repeating the aligning, removing and using steps with subsequent doctor blades in toner hoppers of remanufactured toner printer cartridges of a same model.

17. The method of claim 15 further comprising after the using the toner hopper with the aligned doctor blade step, re-calibrating the doctor blade alignment device with a second calibration toner hopper having a second calibration doctor blade.

18. The method of claim 15 wherein the alignment assembly portion of the doctor blade alignment device comprises:

at least two positioning pin assemblies each having a positioning pin configured to contact the calibration doctor blade or the doctor blade in order to set the doctor blade alignment setting; and, at least two clamp assemblies each locking the positioning pin in place at the doctor blade alignment setting.

* * * * *